US005253959A

United States Patent [19]

MacDonald et al.

[11] Patent Number: 5,253,959

[45] Date of Patent: Oct. 19, 1993

[54] METHODS OF CONSTRUCTION AND IMPLEMENTS THEREFOR

[75] Inventors: Ian G. MacDonald; Ian R. MacDonald; Cameron J. MacDonald, all of Mount Tamborine, Australia

[73] Assignee: Cenefill Pty Ltd, Australia

[21] Appl. No.: 623,927

[22] PCT Filed: May 24, 1989

[86] PCT No.: PCT/AU89/00229

§ 371 Date: Dec. 14, 1990

§ 102(e) Date: Dec. 14, 1990

[87] PCT Pub. No.: WO89/11567

PCT Pub. Date: Nov. 30, 1989

[30] Foreign Application Priority Data

May 25, 1988 [AU] Australia ..... PI8426
Jun. 3, 1988 [AU] Australia ..... PI8597
Aug. 16, 1988 [AU] Australia ..... PI9873

[51] Int. Cl.[5] ..... E02D 3/02

[52] U.S. Cl. ..... 405/279; 405/276; 405/284; 405/274

[58] Field of Search ..... 405/274, 276, 279, 282, 405/283, 284, 272, 262

[56] References Cited

U.S. PATENT DOCUMENTS 782,810 2/1905 Murphy et al. ..... 405/274 X
1,084,120 1/1914 Wemlinger ..... 405/276
1,166,563 1/1916 Wemlinger ..... 405/276
1,502,784 7/1924 Kennedy .
1,764,029 6/1930 Miller .
1,783,523 12/1930 Richardson .
1,888,751 11/1932 Wemlinger ..... 405/276

(List continued on next page.)

FOREIGN PATENT DOCUMENTS 17768 1/1929 Australia .
148206 3/1951 Australia .
277297 3/1965 Australia .
290655 7/1966 Australia .
67208 6/1967 Australia .
93697 11/1983 European Pat. Off. .
54419 5/1890 Fed. Rep. of Germany .
263858 8/1912 Fed. Rep. of Germany .
3543415 6/1986 Fed. Rep. of Germany .
379089 10/1907 France .
422457 3/1911 France .
746674 6/1933 France .
978039 4/1951 France .
2293257 7/1976 France .
2570417 3/1986 France .
2575781 7/1986 France .
496859 11/1970 Switzerland .
542327 11/1973 Switzerland .

OTHER PUBLICATIONS

"Handbook of Drainage and Construction Products", The Armco International Corporation, date unknown.
"Pile Foundations", Robert D. Chellis, B.S., C.E., McGraw Hill Book Company, 1961.
"Metric Sheeting"—Contech Construction Products Inc., Walnut Creek, Calif. date unknown.
Patent Abstracts of Japan, vol. 10, No. 315, Oct. 1986.

*Primary Examiner*—Randolph A. Reese
*Assistant Examiner*—J. Russell McBee
*Attorney, Agent, or Firm*—Larson and Taylor

[57] ABSTRACT

The invention is directed to construction implements and methods for their use in the construction of retaining walls, revetments, road ways, suspended floor spans and the like. The basic element is a support sheet (1) comprising an essentially quadrangular sheet folded about at least one longitudinal axis (2) to produce at least one fold in the sheet. The basic element can be used to construct a load bearing surface at any angle. The basic element can be driven into the ground with the aid of various adapters (6) and attachments (17). Optionally, for additional strength, the sheet can be tied to the grounds by various anchor (26) (52) and rod assemblies (35). Each anchor is pivotally connected to the rod and positioned in the ground in a closed position. When appropriate tension is applied to the rod, the anchor assumes an open position and bites into the ground.

21 Claims, 23 Drawing Sheets

U.S. PATENT DOCUMENTS

| | | | |
|---|---|---|---|
| 1,922,584 | 8/1933 | Heltzel . | |
| 1,956,046 | 4/1934 | Robertson . | |
| 2,170,796 | 8/1939 | Freeze | 405/276 |
| 2,249,818 | 7/1941 | Gifford | 405/276 |
| 2,388,624 | 11/1945 | Tashjian . | |
| 2,730,784 | 1/1956 | Salisbury . | |
| 2,865,180 | 12/1958 | Nielsen . | |
| 2,880,589 | 4/1959 | Wilson et al. . | |
| 3,224,205 | 12/1965 | Greiner et al. | 405/274 |
| 3,226,933 | 1/1966 | White . | |
| 3,228,495 | 1/1966 | Hazell | 405/279 X |
| 3,458,168 | 7/1969 | White . | |
| 3,780,977 | 12/1973 | Dashew . | |
| 3,885,364 | 5/1975 | Lankheet . | |
| 3,969,854 | 7/1976 | Deike . | |
| 4,124,987 | 11/1978 | Hallman et al. | 405/276 |
| 4,211,504 | 7/1980 | Sivachenko . | |
| 4,564,316 | 1/1986 | Hunziker | 405/284 X |
| 4,695,033 | 9/1987 | Imaeda et al. . | |
| 4,863,315 | 9/1989 | Wickberg | 405/274 X |

METHODS OF CONSTRUCTION AND IMPLEMENTS THEREFOR

TECHNICAL FIELD

This invention relates to the construction of walls, revetments, roads, suspended floor spans and the like. In particular, it is directed to a set of construction implements and the use thereof in a general method of construction which is of use in a number of areas.

BACKGROUND ART

When constructing a new building or the like, it is nearly always necessary to first excavate the ground upon which the building is to be erected so that the required footings can be constructed. The usual procedure is to excavate a suitable hole in the ground. The walls of this hole require support so that they will not collapse while the footings are constructed. This support is especially required when constructing a building very close to an existing building. In the absence of a suitable support, the foundations of the existing building may at least move or, at worse, collapse into the adjacent excavation.

For the deep excavations necessary for modern tall buildings such as office blocks and hotels, it is often a requirement that the ground be excavated to a depth of at least six meters. Further, to prevent any movement of adjacent buildings, it is often a requirement that the retaining wall(s) be constructed below ground level *before any* excavation is undertaken.

Similarly, when constructing a new dam, it is often necessary to provide some form of retaining wall around the dam site to prevent passage of the soil etc into the body of water as the dam fills and, also, to retain the body of water itself in the designated area.

Traditionally, such retaining walls have been constructed by the technique of "piling" wherein interlocking piles, each pile being approximately 0.33 m wide and up to 6 m long, are driven (by the repetitive application of a large impact force) into the ground to form a wall of the required width. This method is time consuming and expensive as a large number of piles have to be first driven into the ground and subsequently removed after the building foundations, walls etc have been constructed. Further, the bulk of the piles and the equipment necessary to first support and then drive them into the ground prevents a below-ground retaining wall from being built extremely close to an existing wall of a building or the like. In addition, the large force necessary (e.g. from an impact driver) to drive the piles into the ground results in shock waves through the ground which can damage the foundations of an adjacent existing building.

One alternative method that has been tried is to replace the afore-mentioned piles with sheets of metal. These sheets of metal, which are substantially wider than the piles, are also driven into the ground. However, although this alternative method reduces the time required to erect a retaining wall of given length, it is still necessary to remove the sheets after the building foundations, walls etc have been constructed as the sheets are too expensive to be used once only and thus left in the ground for all time. Further, the gauge of these sheets are such that, to position these sheets, it still requires the above mentioned traditional bulky equipment and the application of large impact forces with their attendant problems.

A modification of this known technique—described in UK Patent No 1074054 —is first to drive a preliminary ramming plate of relatively heavy gauge into the ground which is then withdrawn and a second plate—of lesser gauge—is then inserted into the "slot" thus created.

Although this modified method (using a lesser gauge and thus cheaper to manufacture sheet) may allow the second plate to remain in the ground for all time, it is essential always to create the "slot" before the actual second plate can be inserted into the ground. Thus the time to erect a retaining wall is not significantly reduced and the ramming of the first plate into the ground still involves large impact forces with their accompanying problems.

When constructing a revetment, it is nearly always necessary first to drain the water from where the revetment is to be erected so that the required footings can be constructed. Alternatively, where draining is not practical (e.g., on a foreshore), work on footings and the like can only be undertaken at low tide or by first diverting the flow of water away from the construction area.

The revetments are then traditionally constructed from rock or stone which is positioned where required, either dry-stacked or, if necessary, further held in position by cement or by placing a net-like structure (usually manufactured from metal) thereover. These methods are time consuming and expensive as they are labour intensive and, usually, the rock or stone has to be carted from an area remote from the revetment construction.

One alternative method that has been tried is to prepare the land where the revetment is required to provide the desired contour for the revetment, for example, by excavation or mounding with earth or rubble and placing thereover a double walled mattress which is then filled with concrete by pressure injection. This alternative method is still not totally satisfactory as, for example, if excavation is required to set the desired contour, draining or diverting of water may still be required.

Further problems with the known prior art include (1) for the deep excavations necessary for modern tall buildings, the required retaining walls often have an exposed face which is of substantial depth and thus the ground pressure on the other side can be substantial and may cause these retaining walls to move inward away from the required angle under the influence of this pressure; and (2) similarly, when such walls or revetments are placed in soft soils such as sand or similar, particularly when wet, movement of the walls is likely.

Traditionally, such retaining walls have been anchored by using a concrete grout wherein a threaded hole is bored into the soil, concrete is then poured into the hole and metal cables are embedded therein. Once the concrete has cured, the metal cables are secured to the retaining wall to prevent movement thereof.

Disadvantages of this traditional method include (1) soil has to be removed before the concrete is poured in, requiring special drilling equipment; (2) several days are required for the concrete to cure before the grout can be used; (3) if insufficient grout is added to replace the removed soil, subsidence can occur of the surrounding area; (4) the drilling equipment is bulky and problems thus arise if the grout has to be placed near existing foundations of, for example, an adjacent building; (5)

the anchoring system has to be "destressed" in due course; (failure to destress is highly likely to allow subsidence and other movement of the surrounding soil which could cause damage to the new construction and/or to adjacent buildings); and (6) a concrete grout is permanent, there being no reusable materials.

The above discussion has described existing problems associated with the construction of support walls which are to be erected in an essentially vertical position. However, "horizontal" supports of considerable strength are also required, for example, in large suspended floor spans such as those necessary in modern office and retail complexes and, particularly, in the construction of roads, bridges and the like.

The traditional bridge building material, timber, is now out of favour as its cost is increasing and supplies are becoming more difficult to obtain. Timber bridges also require significant regular maintenance. Accordingly, the repair and replacement of the decking of existing wooden bridges and the construction of new bridges now tends to be undertaken using alternative materials, most commonly reinforced concrete or steel sheets covered by some suitable load bearing material.

Although reinforced concrete is immensely strong and durable, large and thus expensive quantities are required if the concrete is to be the only supporting surface. Extensive formwork is also required to contain the concrete until it has set. Therefore, in an attempt to overcome this problem, steel decking has been utilised whereby profiled steel panels are first laid down and then covered with any suitable infill material. These fill materials vary from compacted earth to structural grade concrete.

A disadvantage of this steel decking alternative is that the road surface is not load bearing until the infill material has been positioned. This usually necessitates the infill material to be positioned manually as the initial steel decking is not strong enough to support the large and heavy vehicles, such as concrete-containing vehicles, which deliver the material. The required manual distribution of the infill material is time consuming, labour intensive and thus relatively expensive.

DISCLOSURE OF THE INVENTION

It is a general object of the present invention to overcome, or at least ameliorate, one or more of the above problems and to provide construction implements and methods for their use which are suitable for a wide range of applications whereby substantial load bearing support is required in essentially any direction.

It has been discovered by the present inventors that, if the known sheets are replaced with sheets of a particular profile, the sheets thus profiled are immensely strong and can, for example, be positioned using less bulky equipment. If necessary, they can be positioned in the ground by the application of much lower driving forces and, further, can be produced economically enough to remain in the ground for all time if their removal is impractical. Also, the insertion of the sheets into the ground can be direct thus eliminating the need for any preliminary ramming plate to carve a "slot" for the sheets. Should conditions require, the sheets can be further tied to the ground by use of an anchor(s) also developed by the present inventors. In addition, the sheets can be positioned horizontally and, in this application, are ready for immediate use as they are sufficiently load bearing without further treatment.

Thus, according to a first aspect of the present invention, there is provided a support sheet for use in the construction of a load bearing surface such as a retaining wall, floor span, roadway or the like, said support sheet comprising:

an essentially quadrangular sheet folded about at least one longitudinal axis to produce at least one fold in said sheet.

In their application as part of, for example, a retaining wall, as the support sheets of the present invention are of a lesser gauge than the conventional prior art sheets, it has been found that a much lower driving force is necessary to drive the support sheets into the ground. However, because of the lesser gauge and thus reduced rigidity of the sheets, there could be a tendency for the sheets to buckle under the driving force in certain circumstances. This problem can be overcome by affixing an adapter to the top of the support sheet prior to its insertion into the ground. It has been found that, by applying a vibrating force to the adapter, the support sheet can be driven almost to its full length into the ground. The adapter is then removed and the support sheet is driven to ground level by the aid of an attachment fitted between the support sheet and the source of the vibrating force.

Therefore, as a second aspect of the present invention, there is provided an adapter for a support sheet as hereinbefore defined, said adapter comprising:

a) an essentially quadrangular sheet folded about at least one longitudinal axis to produce at least one fold in said sheet; and (b) means to releasably attach the adapter to said support sheet;

wherein the number and position of said at least one fold are essentially identical to that of said support sheet.

As a third aspect of the present invention, there is provided an attachment for a support sheet as hereinbefore defined, said attachment comprising:

1) an essentially elongated member adapted to communicate with the top of said support sheet; and 2) means to releasably connect said elongated member to a source of a vibrating force.

In some circumstances, it is known that, below ground, there may be tree roots, rocks and other debris which may prevent the easy penetration of the support sheet. Similarly, after commencement of the driving of the support sheet, progress may be halted as one unexpectedly encounters roots, rocks etc. This problem can be overcome by the use of a cutter sheet—of complementary shape to the aforedefined support sheet but of heavier gauge—which is first driven into the ground and then removed to create a passage for the support sheet.

Therefore, as a fourth aspect of the present invention, there is provided a cutter sheet capable of being driven into the ground to cut tree roots, to split rocks and the like, said cutter sheet comprising:

an essentially quadrangular sheet folded about at least one longitudinal axis to produce at least one fold in said sheet;

wherein said sheet is capable of being driven into the ground to at least ground level to cut tree roots, to split rocks and the like that may be present therein.

As a fifth aspect of the present invention, there is provided a method of constructing a retaining wall or the like, said method comprising:

selecting a support sheet as hereinbefore defined;

if necessary, affixing said support sheet to an adapter as hereinbefore defined;

positioning said support sheet to at least an approximation of its required relationship to the ground:

if appropriate, removing said adapter; and/or if necessary, placing an attachment as hereinbefore defined in communication with the top of said support sheet and further positioning said support sheet until the required relationship to the ground is attained.

It has also been discovered by the present inventors that the support sheets as hereinbefore defined and their method of use can be used to produce any required contour for any particular revetment. After the sheets have been positioned, if necessary, the soil or the like is excavated from the water side of the proposed revetment and a casing is overlaid onto the water side face of the sheet and the casing is filled with a suitable robust material.

As a sixth aspect of the present invention, there is provided a method of constructing a revetment—either above and below water—said method comprising:

selecting a support sheet as hereinbefore defined;

positioning said sheet to the required level and at the required angle;

if appropriate, excavating the soil or the like from one face of said sheet; and overlying a casing or the like on said one face, wherein said casing can be filled with a suitable robust material.

As an optional feature of the above-defined methods is the use of a cutter sheet as hereinbefore defined wherein, prior to selecting a support sheet, a cutter sheet is driven into the ground at the required angle and to the required depth to cut tree roots, to split rocks, and the like that may be present in the ground, the cutter sheet then being removed. Alternatively, if tree roots, rocks or other debris is unexpectedly located while driving the support sheet, the support sheet can be removed and the cutter sheet used as above described before replacing the support sheet in the ground.

Of course, it will be appreciated that, if necessary, a second support sheet can be driven into the ground so that it partially overlaps the adjacent first support sheet. Similarly, if extraordinary depth is required—a depth which is impractical to achieve using a single support sheet—a first support sheet can be driven to ground level and then a second sheet —with suitable hooks attached at its lower edge—affixed to the top edge of the thus-driven first sheet. This second sheet is then driven into the ground forcing the first sheet to below ground level. These processes can be repeated until a retaining wall of the required length and/or depth has been constructed. Optionally, a high tensile bolt is used to hold the overlapped sheets closely together at or near the top of the sheets, it being found that ground pressure is sufficient for close contact at the base of the sheets.

For revetments and similar, once the required length and depth have been obtained, the casing is overlaid for the full length and then filled with the robust material.

Although the number and position of the fold(s) on the sheets and adapter may vary dependent on the application required, preferably, the cutter and support sheets and the adapter each comprise more than one fold to produce a series of double folds (pleats) symmetrically placed along the full width of the respective sheets. More preferably, each sheet and the adapter are folded between five and seven times.

Preferably, the means to releasably attach the adapter to the top of the support sheet comprises (a) two L-shaped brackets affixed so that said support sheet can be positioned between the planar sheet of the adapter and each said bracket and (b) holes in said brackets and in said support sheet which are aligned when said adapter is in use, allowing a bolt or similar to be passed through to connect said adapter and said support sheet together.

Preferably, the elongated member of the attachment for use with the support sheet is a channel of square C cross-section, the width of the channel being slightly greater than the depth of the pleats of the support sheet. This channel member may optionally be further adapted to comprise extended sides of a profile complementary to that of the support sheets.

For revetments and the like, preferably, the casing is a double walled nylon mattress woven of multi-filament nylon wrap held together at intervals by filter points which remain free of the robust filling and are designed to relieve hydrostatic pressure.

Preferably, the robust material used as the filing is sand or concrete. More preferably, the filling is fine aggregate concrete which is pressure injected into the casing.

Optionally, the support sheets can be coated with any suitable preservative composition to further increase resistance to abrasion, water erosion, rusting etc.

In some soils, or where very deep excavation is required, it may be necessary to anchor the abovedescribed support sheets and building element to prevent their excessive movement.

Thus, according to a seventh aspect of the present invention, there is provided an anchor for use in securing a retaining wall, revetment or the like in position said anchor comprising:

an elongated rod having a blade-like soil engaging means pivotally connected at one end and capable of movement from a first closed position to a second open position, the other end of said rod being adapted to be secured to said retaining wall, revetment and the like.

As an eighth aspect of the present invention, there is provided a method of anchoring a retaining wall, revetment or the like in soil, sand or similar, said method comprising:

1) passing at least one anchor as hereinbefore defined and in said first closed position through said wall, revetment or the like and into the soil, sand or similar at the required angle and to the necessary depth;

2) causing said blade-like means to assume said second open position; and 3) subsequently or simultaneously with assuming said second open position, securing said other end of said rod to said wall, revetment or the like in such a manner to substantially prevent any movement of said wall, revetment or the like under the influence of ground or other pressure or similar.

Preferably, the rod is externally threaded along its whole length and is capable of being secured to said retaining wall, revetment and the like by means of a conventional threaded nut.

The shape of the anchor, its manner of insertion into the soil and its overall operation varies dependent on the type of soil in which the retaining wall, revetment or similar is being constructed.

For example, in soft or wet soil, sand or the like a relatively broad, blade-like soil engaging means is required. An outer casing is positioned over said rod, one end of said casing being releasably affixed to a first adapter which engages said blade-like means to releasably retain said means in the first closed position, the other end of the outer casing being affixed to a second adapter which, in turn, is releasably affixed to a source of a repetitive impact force.

The anchor, secured in its closed position, is driven into the ground at the required angle and to the necessary depth. The outer casing and both adapters are removed and the end of the rod secured to the necessary tension to the retaining wall, revetment or similar.

On the other hand, in heavily compacted or rocky-type soils, a relatively narrow blade-like soil engaging means may be required. The necessary channel is first created in the soil at the required angle and to the necessary depth and the anchor, with threaded rod attached, is manually inserted into the channel. The end of the threaded rod is then secured to the retaining wall, revetment or similar.

It has been further discovered by the present inventors that the above-discussed support sheets are also load bearing in an essentially horizontal position and thus find use in the construction of suspended floor spans, roadways, bridges and the like.

When the support sheets are used in the construction of a roadway, bridge or the like, each sheet is preferably positioned such that the said at least one fold is positioned transverse to the flow of the traffic that will use the road bridge. Preferably, in this embodiment, each support sheet further comprises a narrow flange along the full length of both longitudinal edges of the support sheet; each successive support sheet is positioned such that adjacent flanges overlap; conventional metal mesh, such as that used for the reinforcement of concrete road ways, is affixed to the upper surface of the support sheets; a continuous-type edge capping is secured to either side of the support sheets to assist in the retention of infill material; and any suitable infill material is positioned on the upper surface of the support sheets and between the side edge capping to the required depth.

DETAILED DESCRIPTION OF EMBODIMENTS

Preferred embodiments of the present invention will now be described with reference to the accompanying drawings in which.

Figure 2:
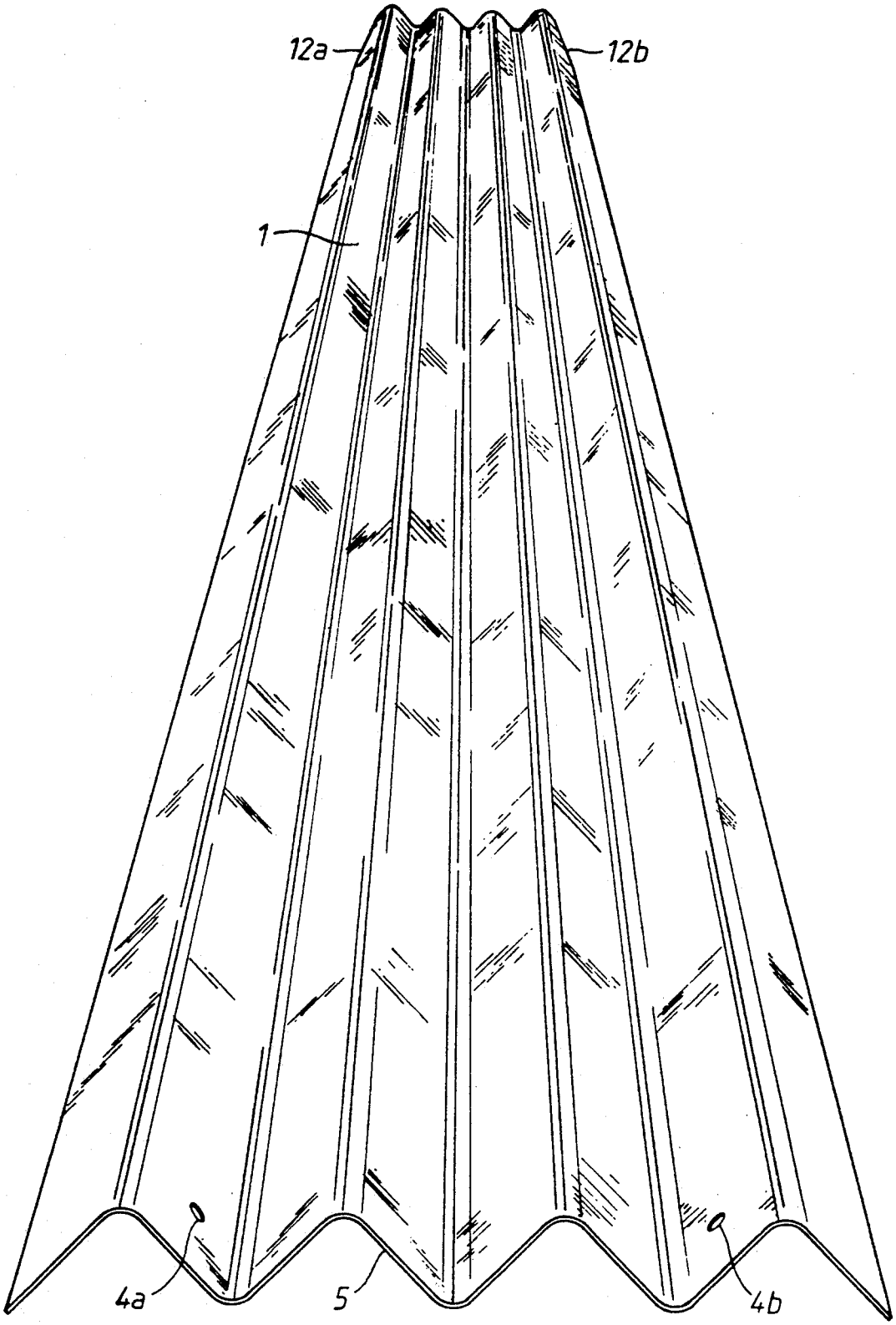
FIG. 2 is a perspective sketch of a support sheet constructed in accordance with the present invention.
Figure 3A:
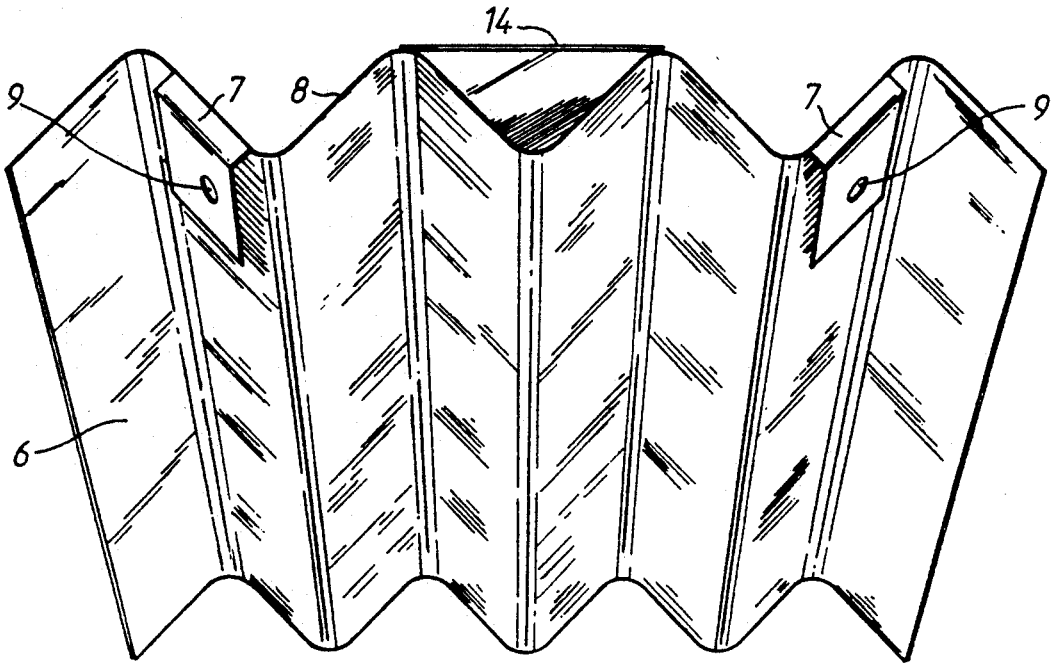
Figure 3B:
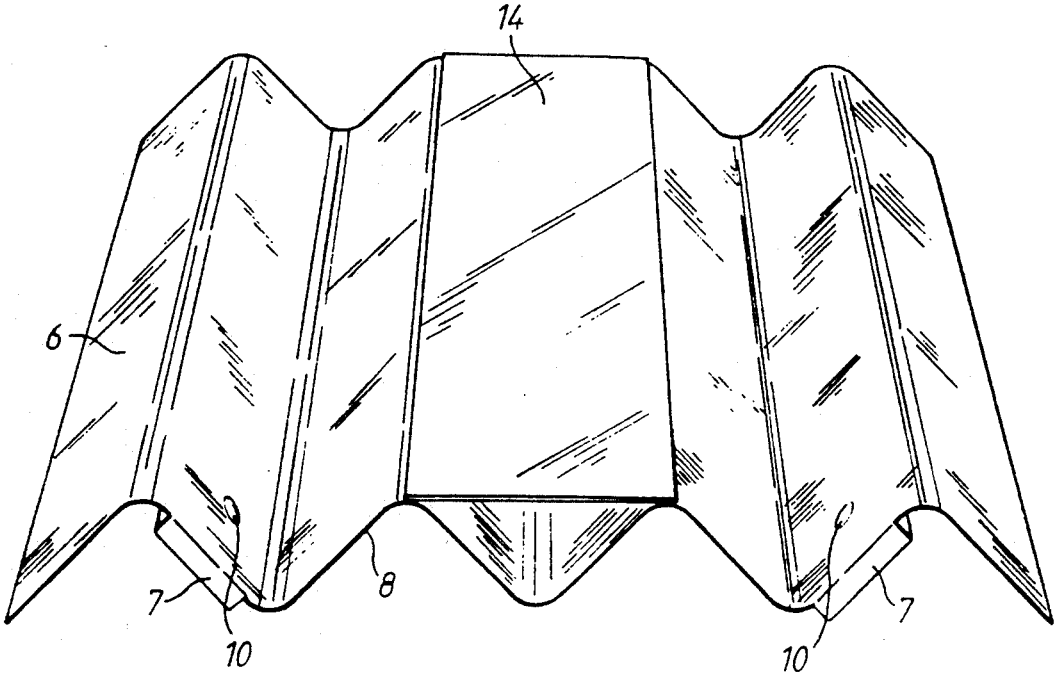
Figure 3C:
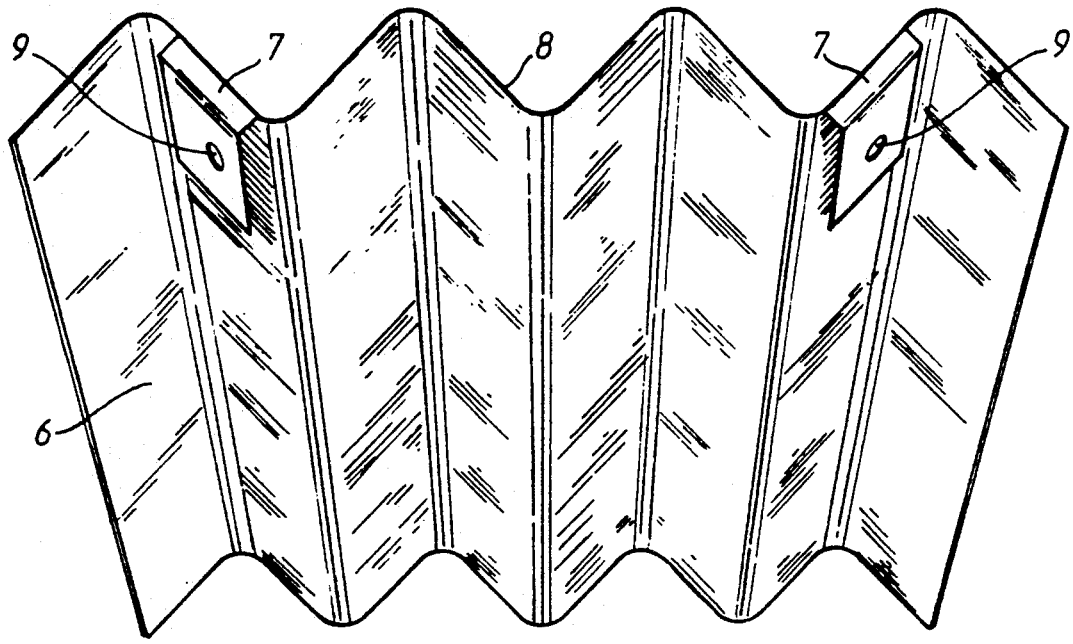
Figure 3D:
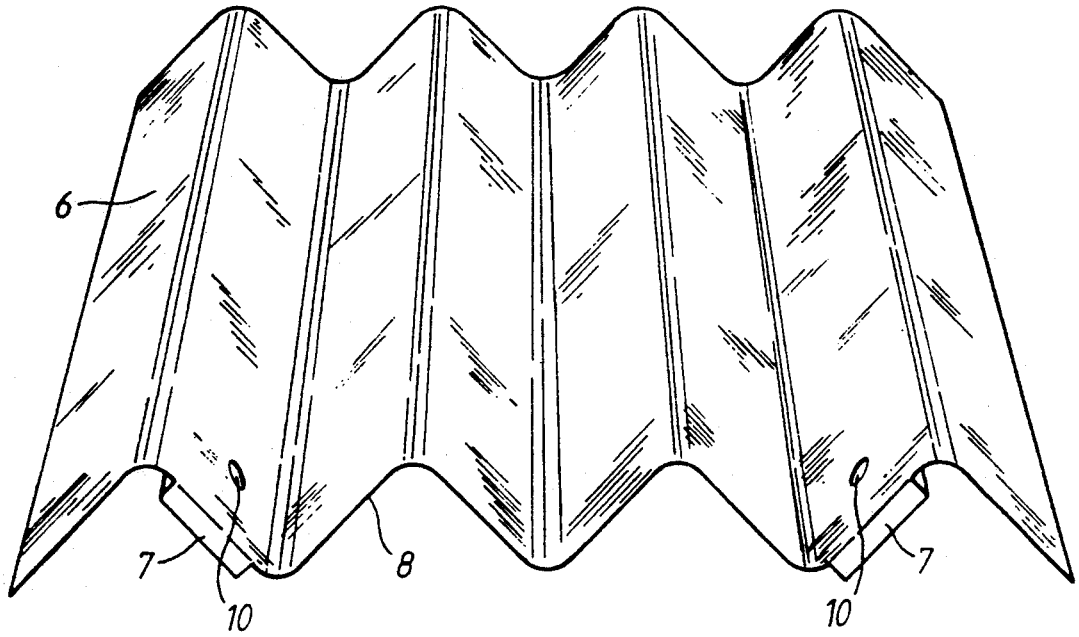
Figure 4A:
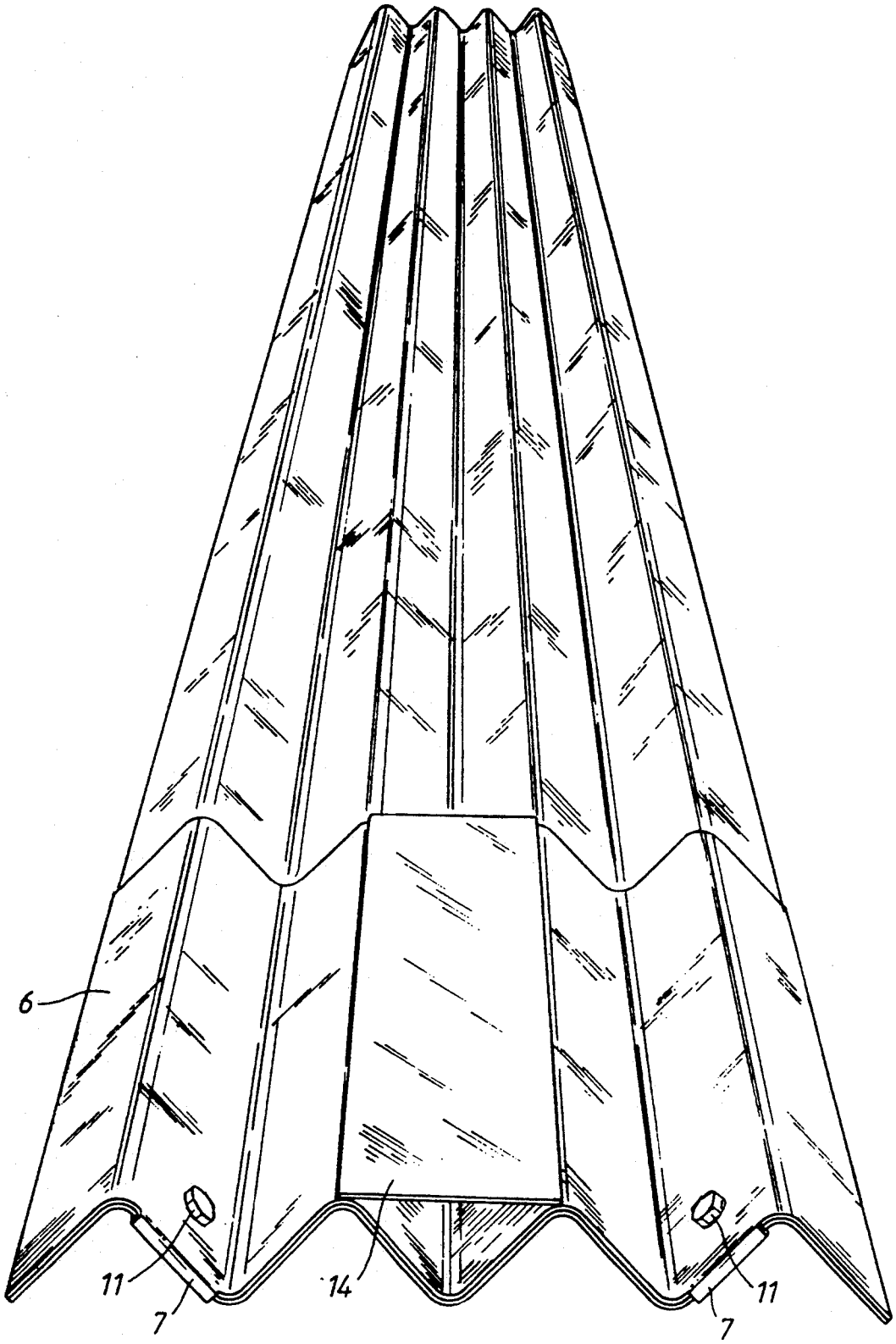
Figure 4B:
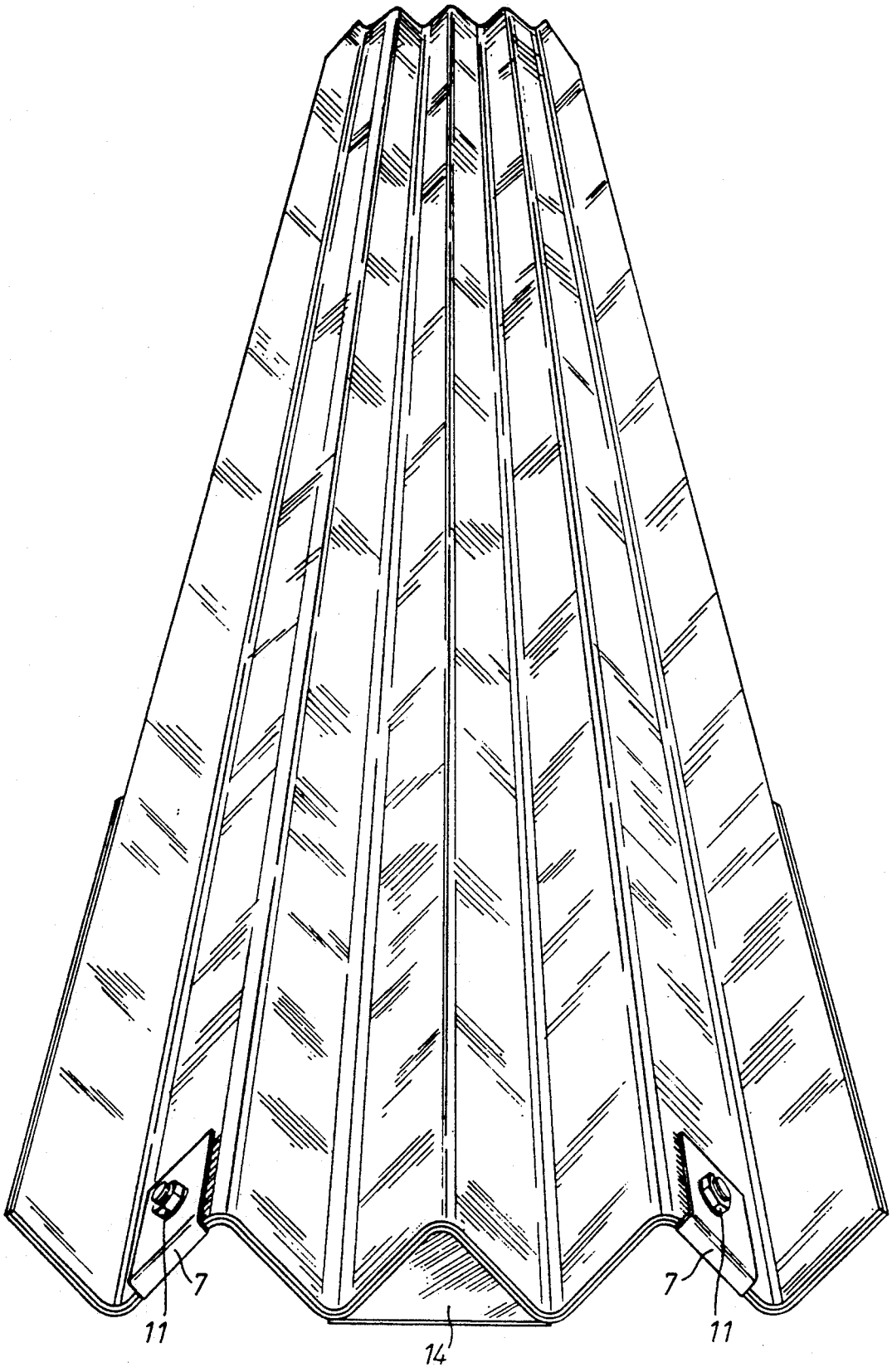
Figure 4C:
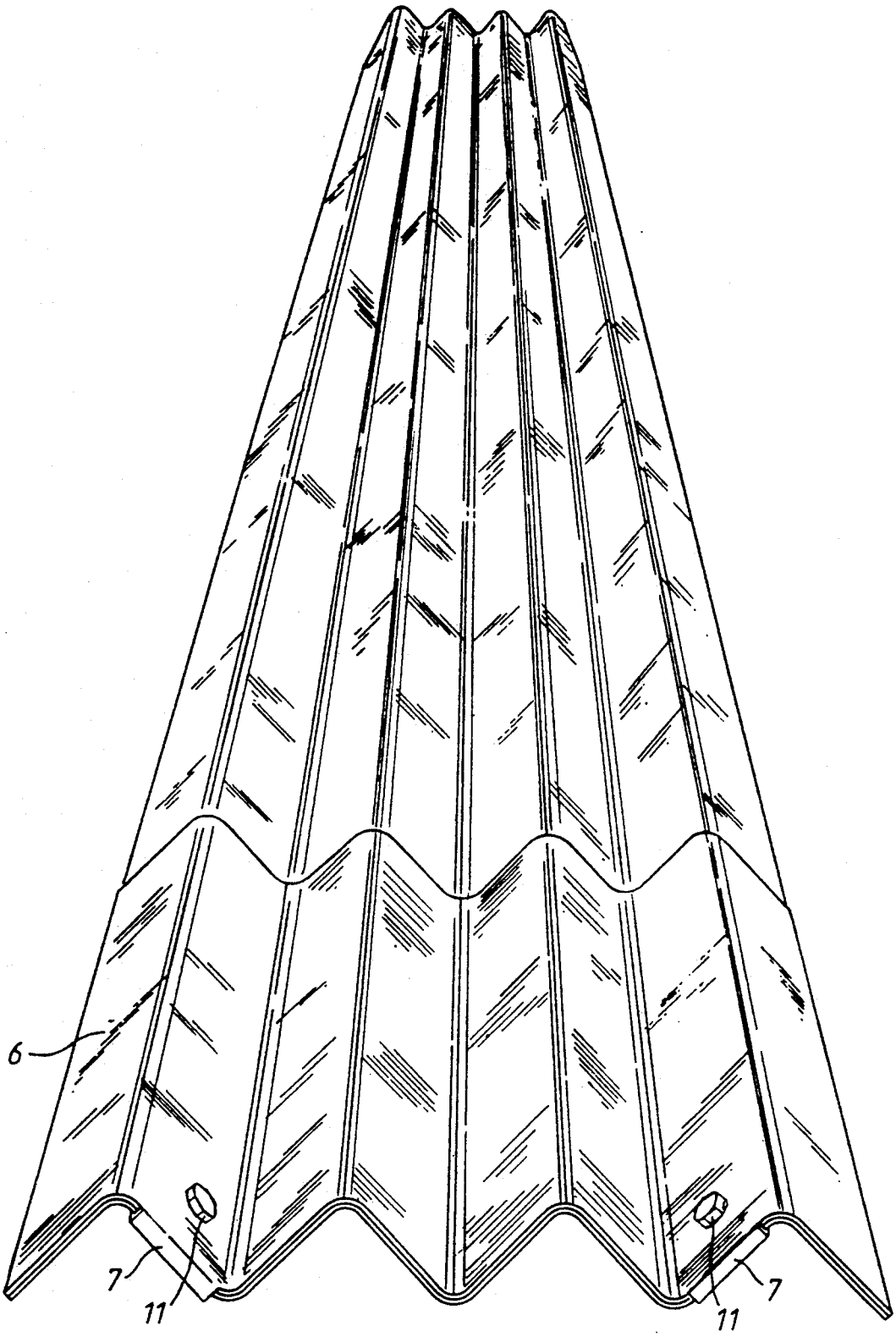
Figure 4D:
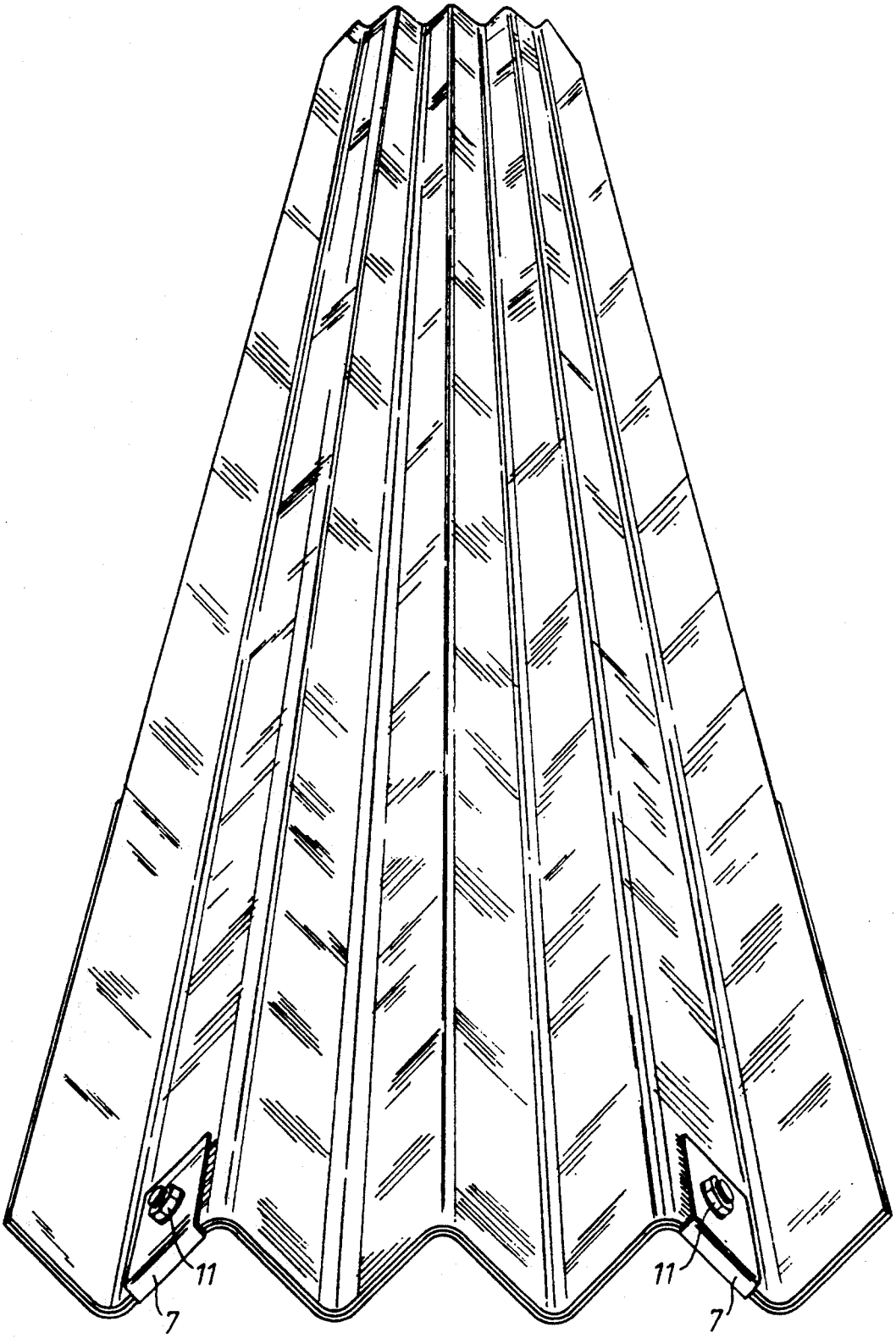
Figure 5A:
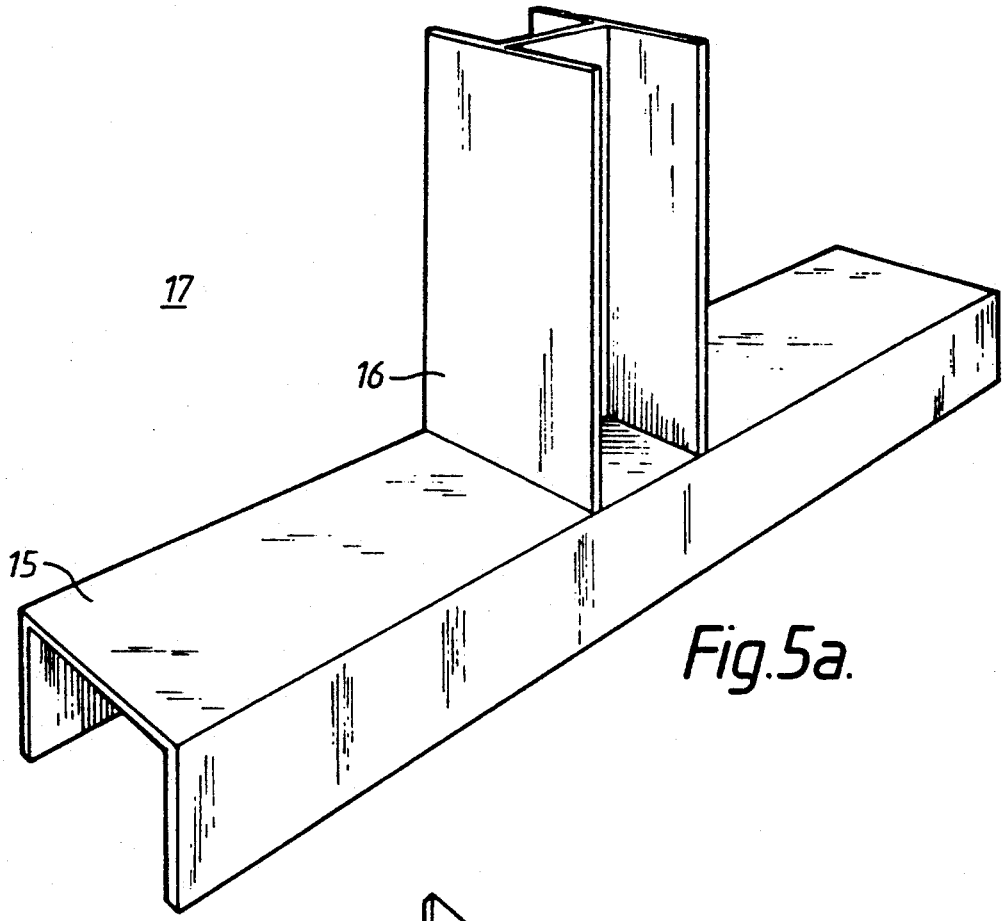
Figure 5B:
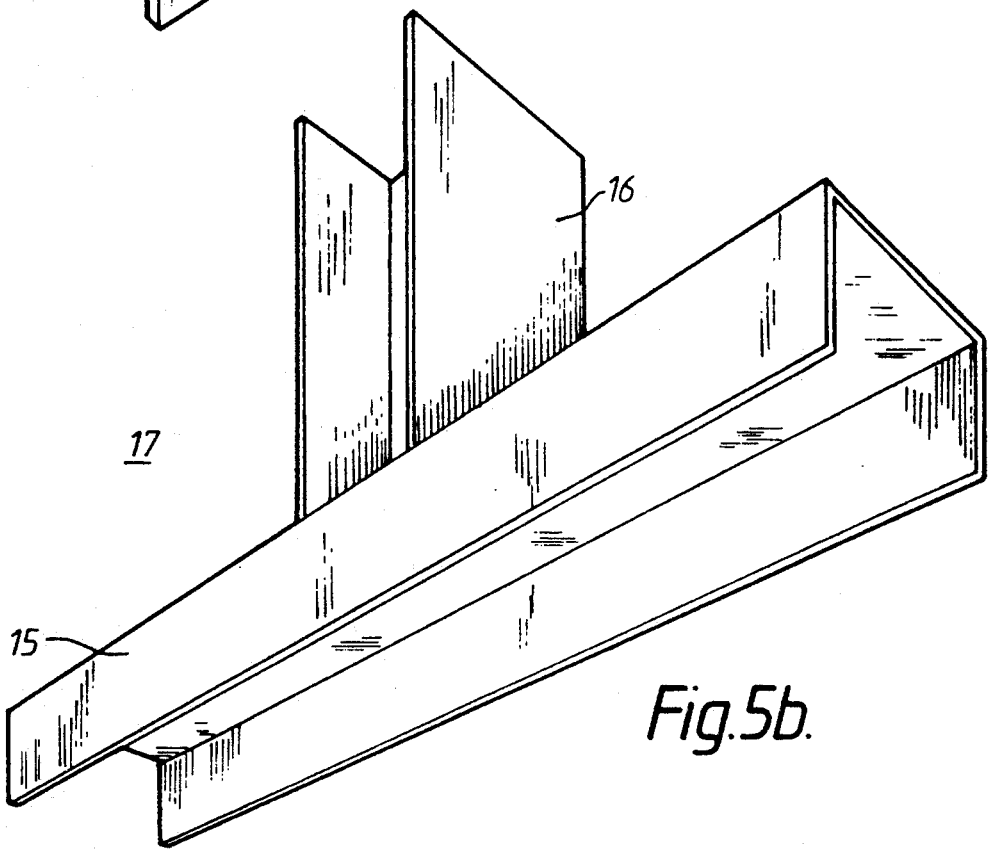
Figure 5C:
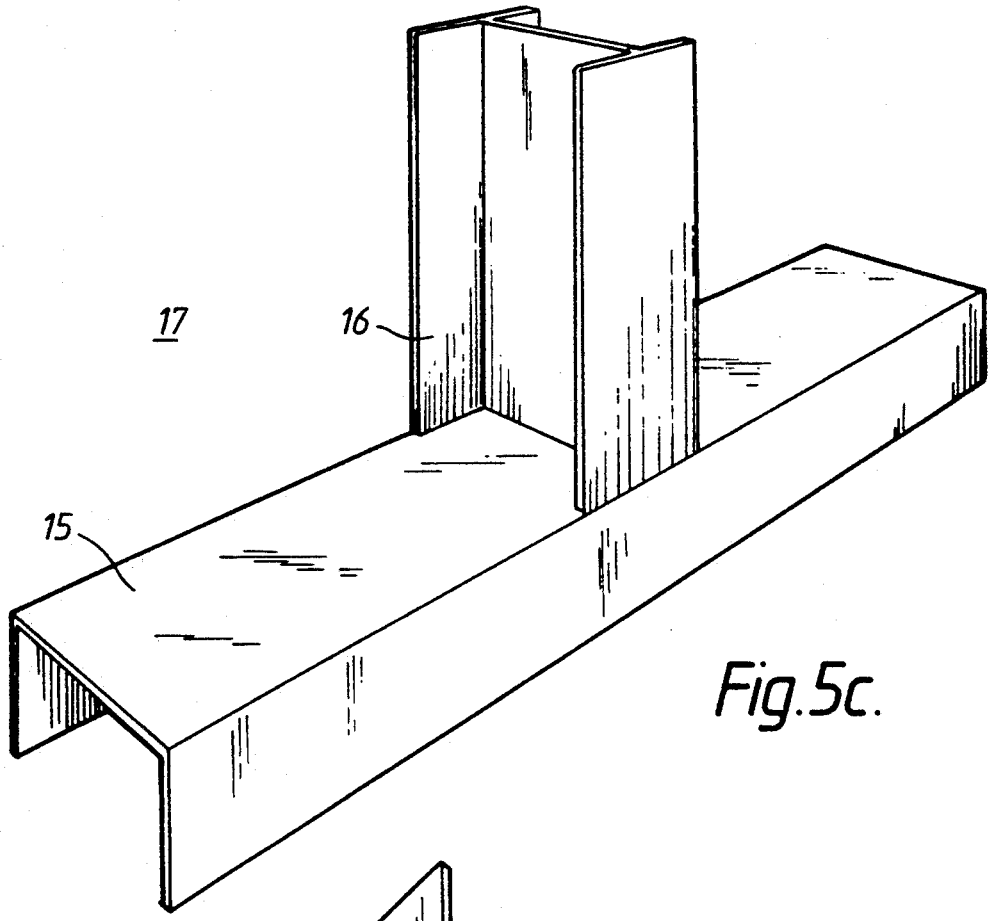
Figure 5D:
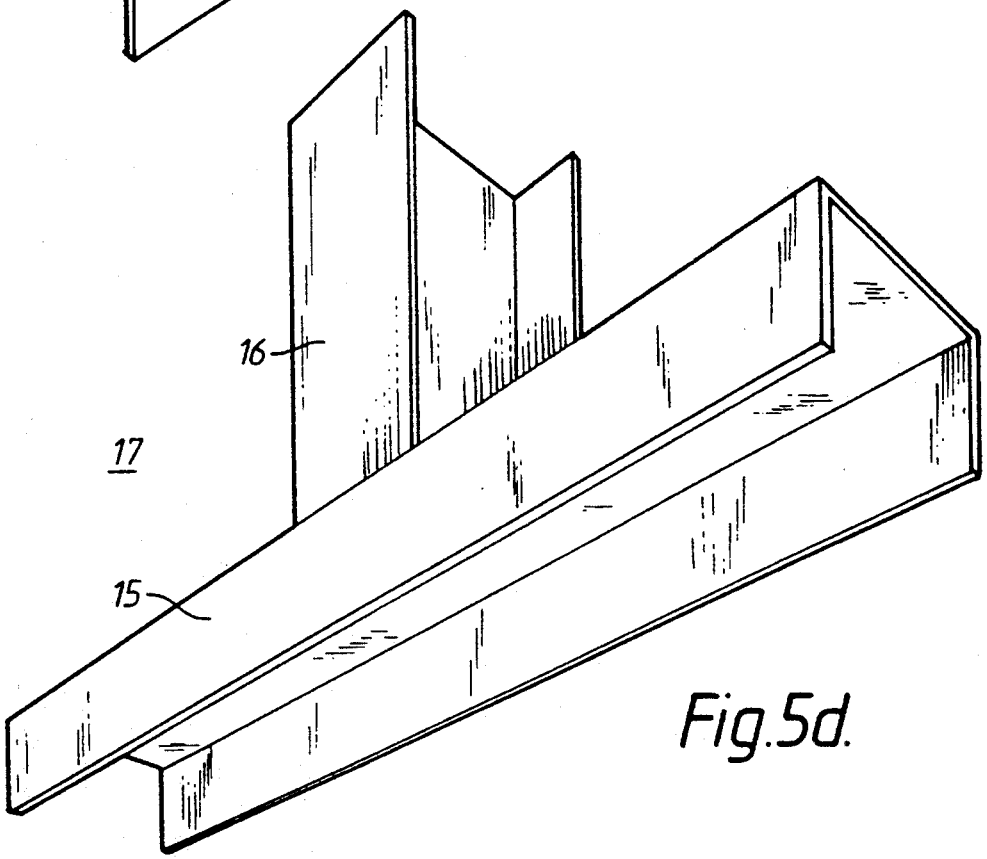

FIGS. 3*a* and 3*b* and FIGS. 3*c* and 3*d*, respectively are sketches of two adapters for use with the support sheet illustrated in FIG. 2;

FIGS. 4*a* and 4*b* and FIGS. 4*c* and 4*d*, respectively are sketches of the adapters illustrated in FIGS. 3*a* and 3*b* and FIGS. 3*c* and 3*d* respectively, connected to the support sheet depicted in FIG. 2.

FIGS. 5*a* and 5*b* and FIGS. 5*c* and 5*d*, respectively are sketches of two forms of an attachment constructed in accordance with the present invention.

Figure 6:
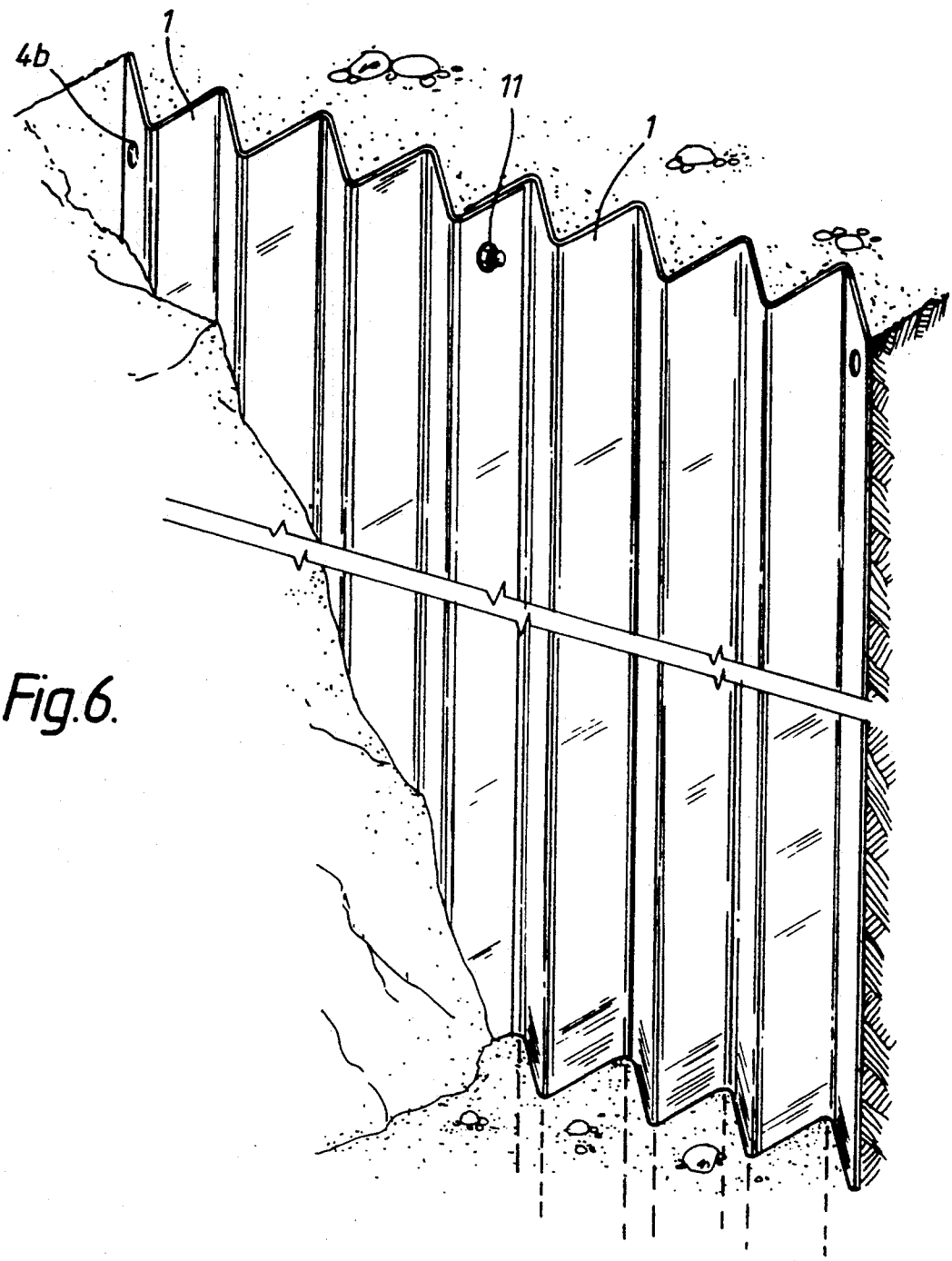

FIG. 6 is a retaining wall constructed in accordance with the present invention.

Figure 7:
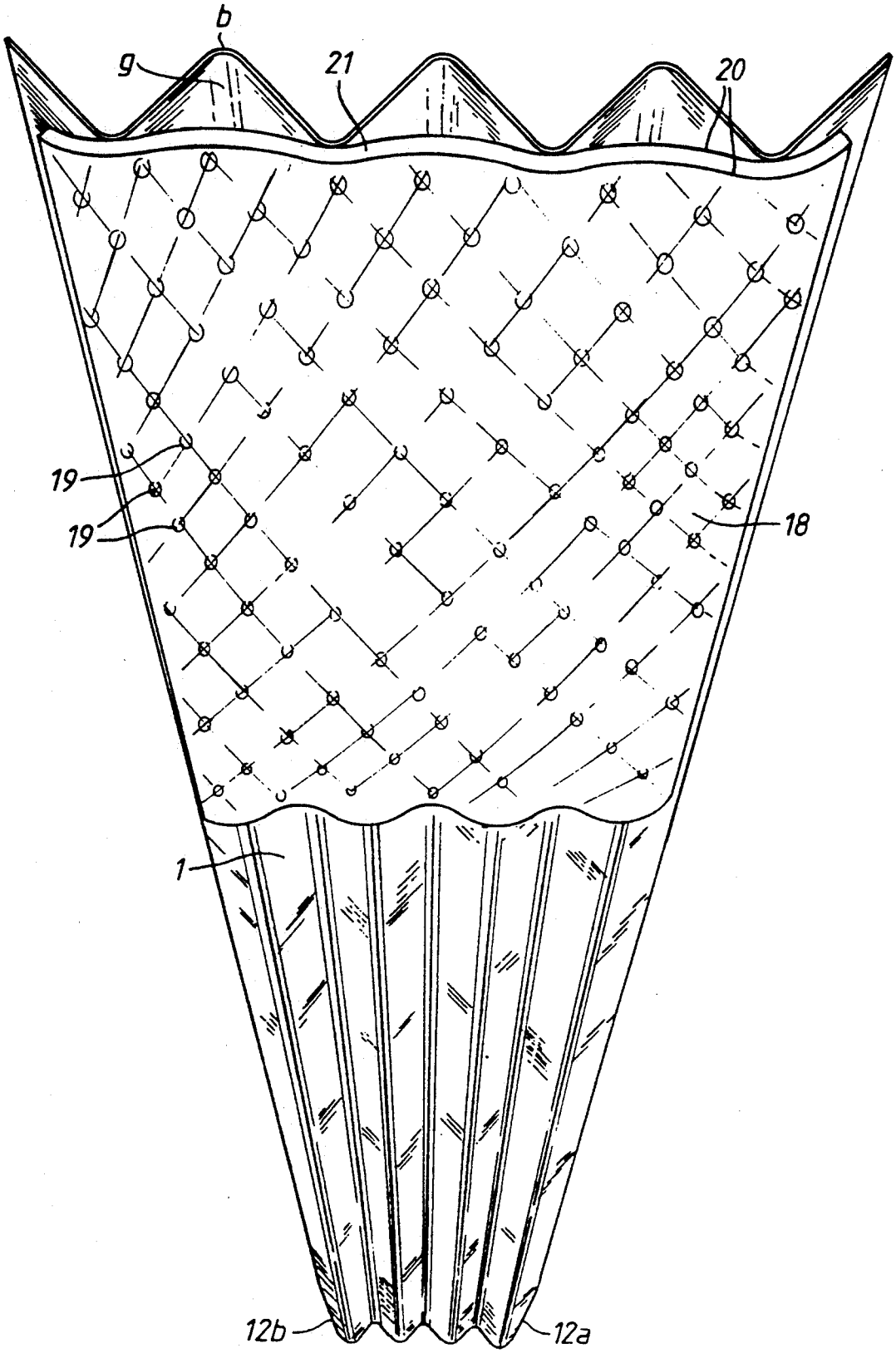
Figure 8:
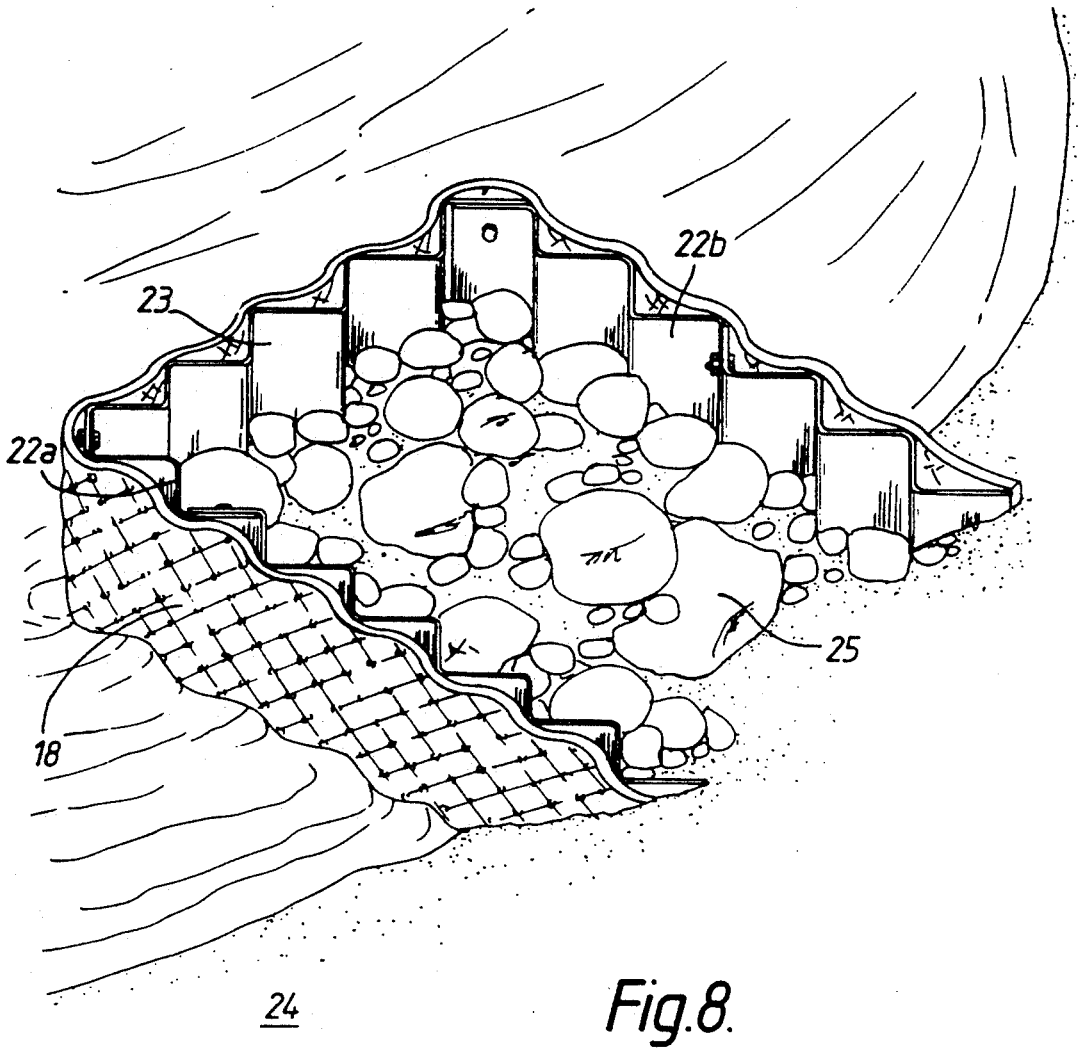

FIG. 7 is a sketch of a building element constructed in accordance with the present invention;

FIG. 8 is a sketch of a breakwater constructed in accordance with the present invention.

Figure 9A:
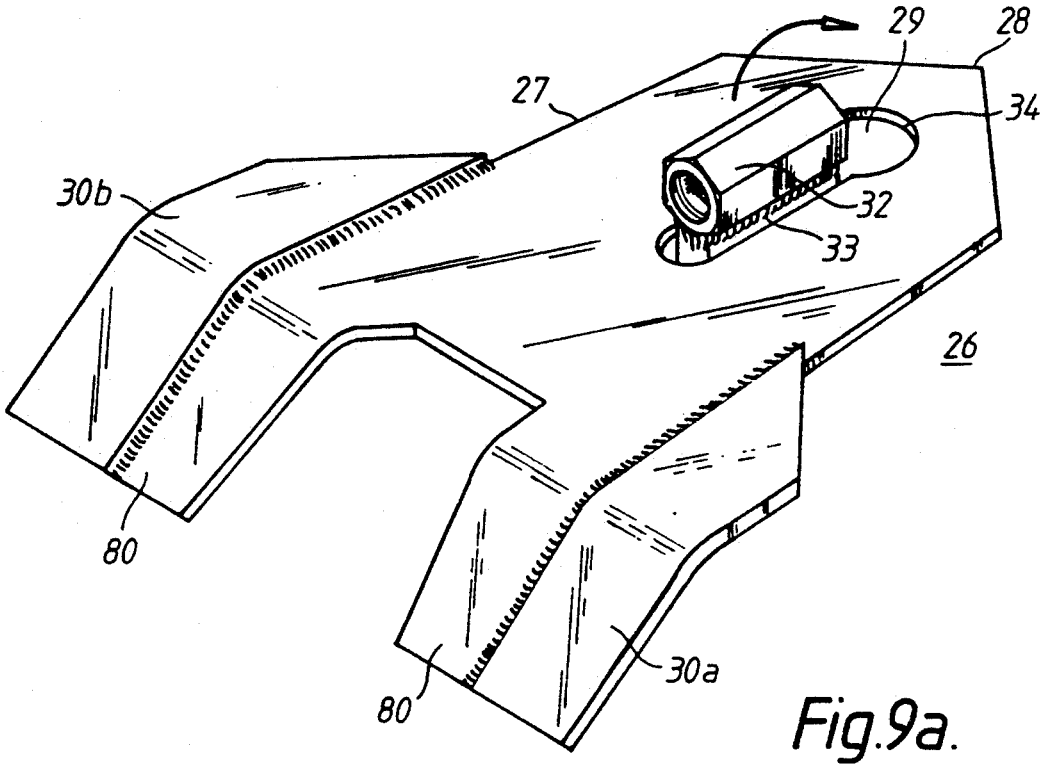
Figure 9B:
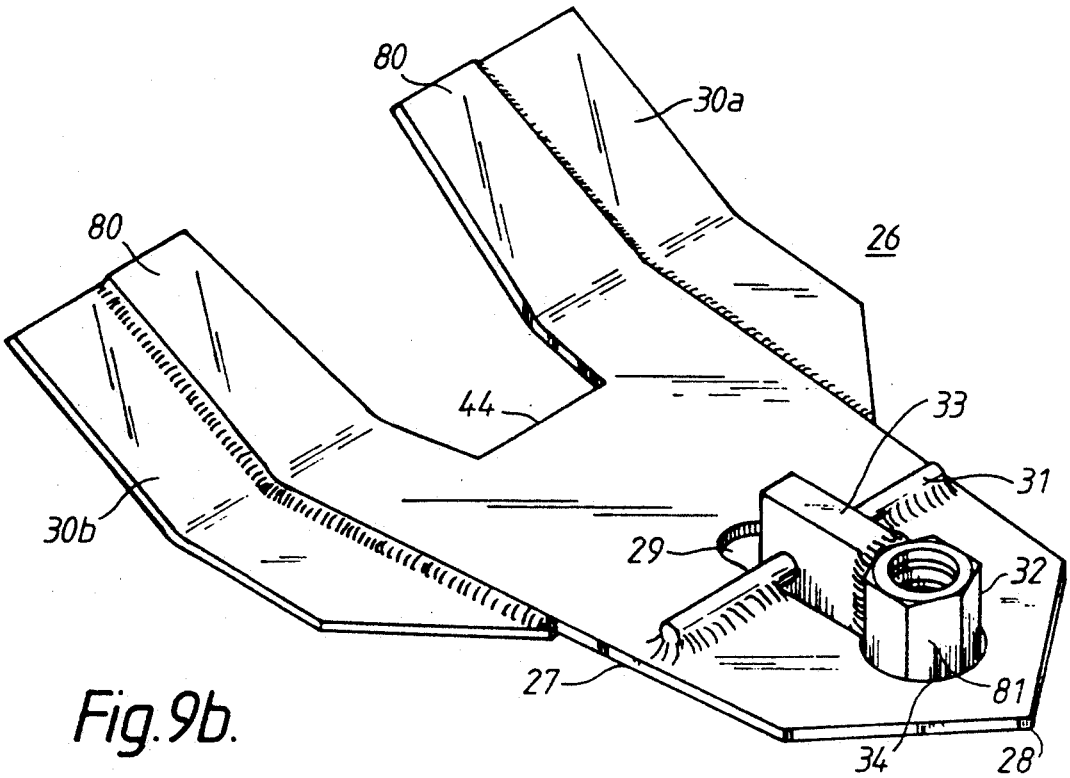
Figures 10, 11:
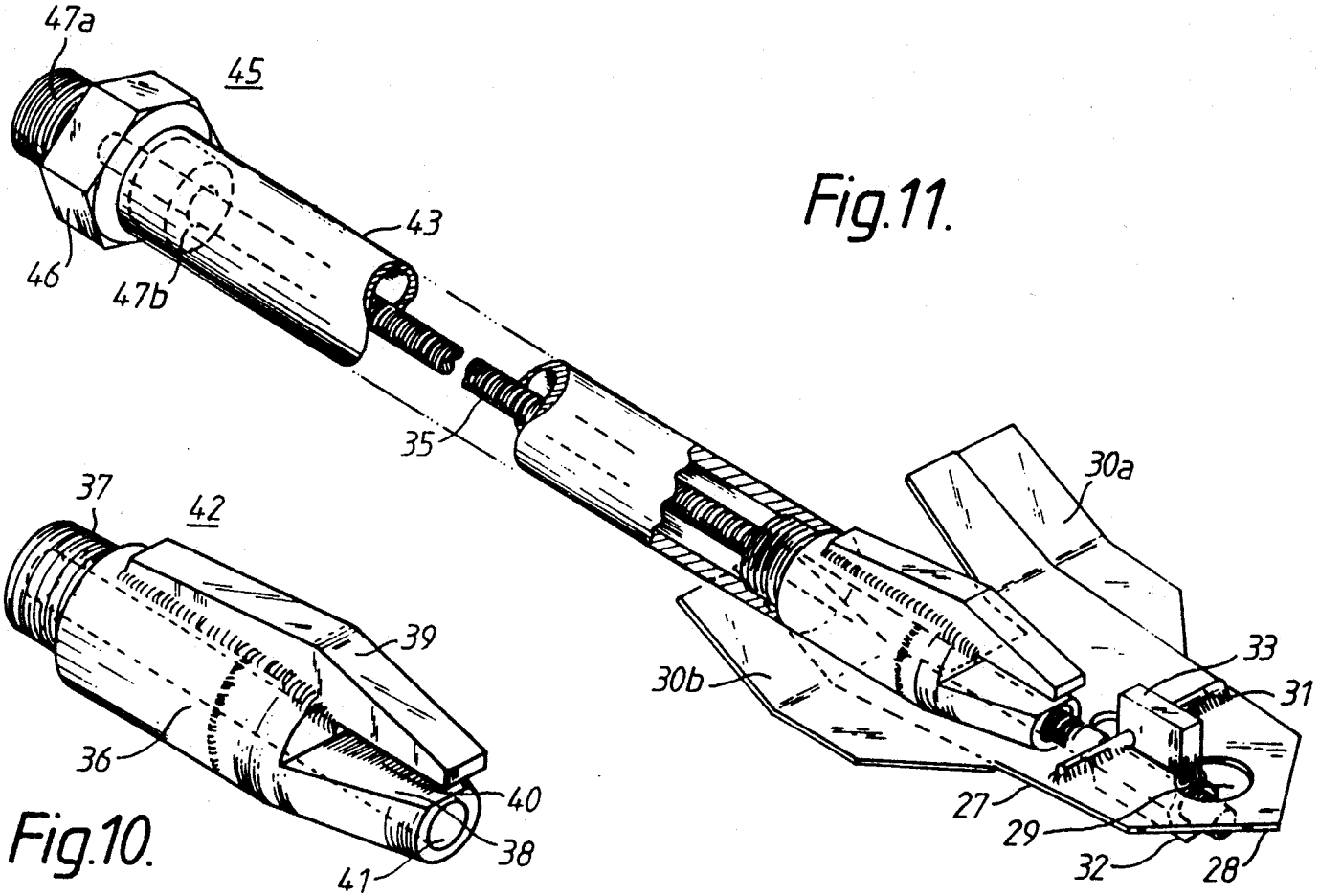
Figure 12A:
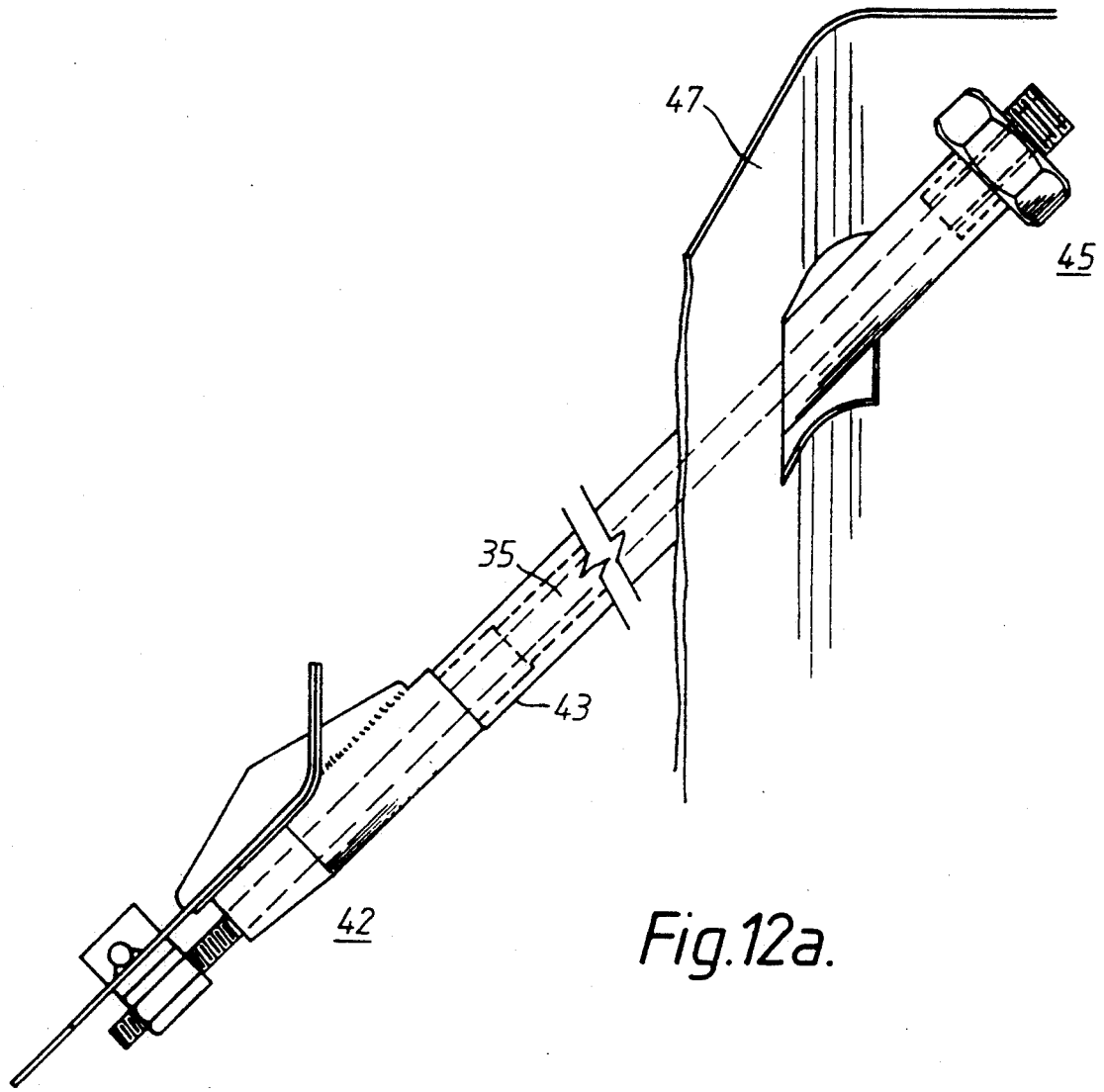
Figure 12B:
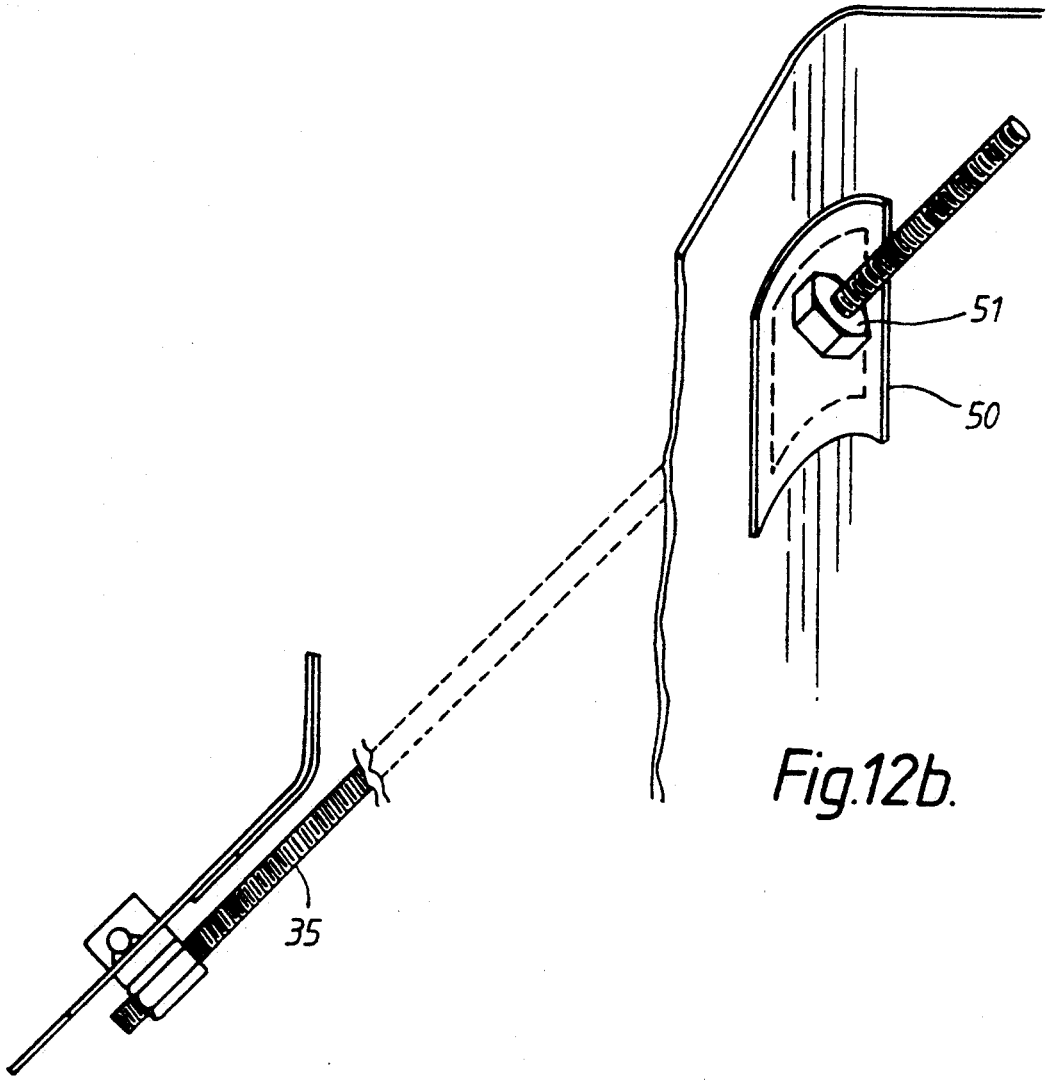
Figure 12C:
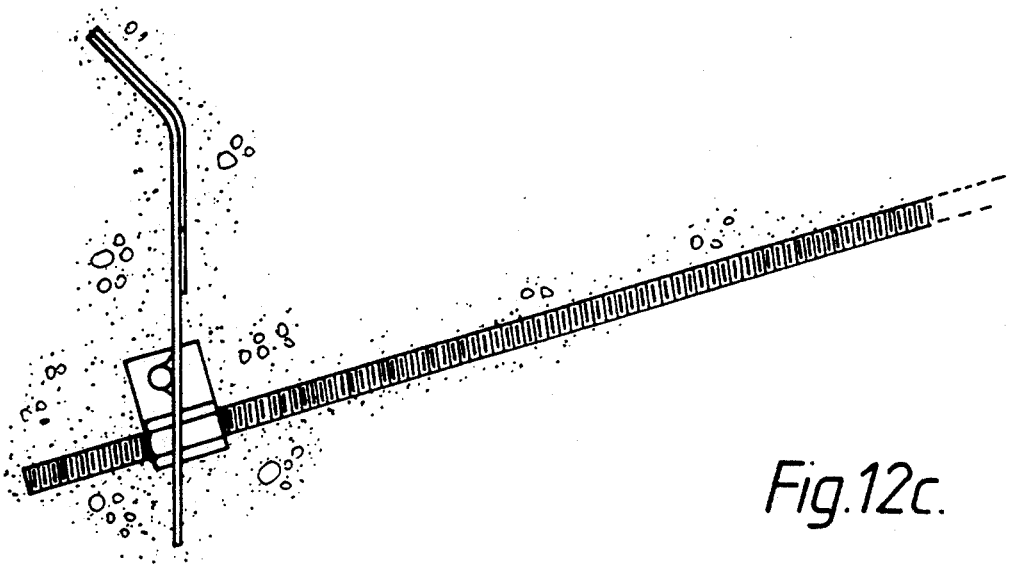
Figure 13A:
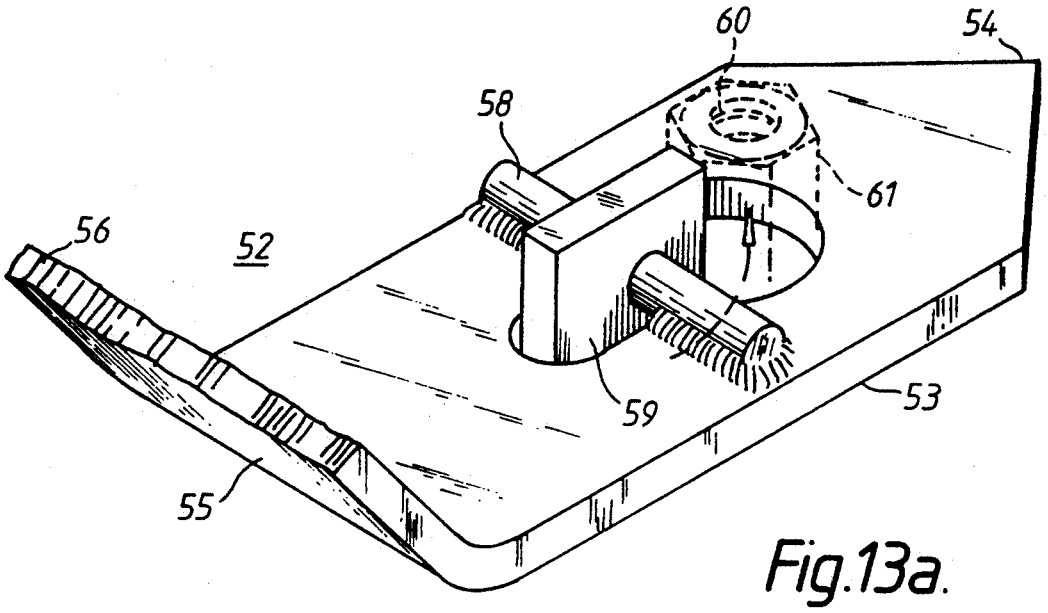
Figure 13B:
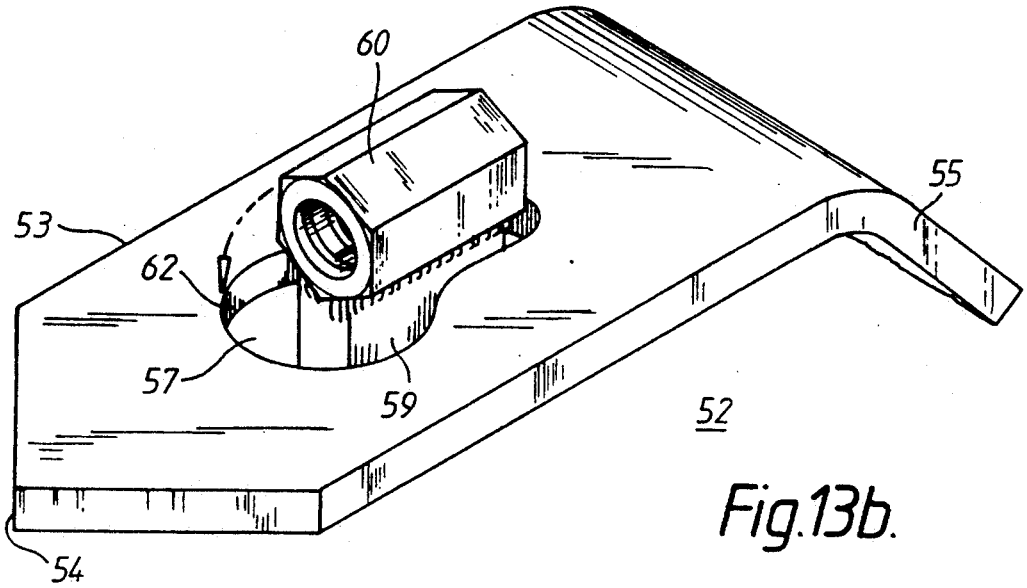
Figure 13C:
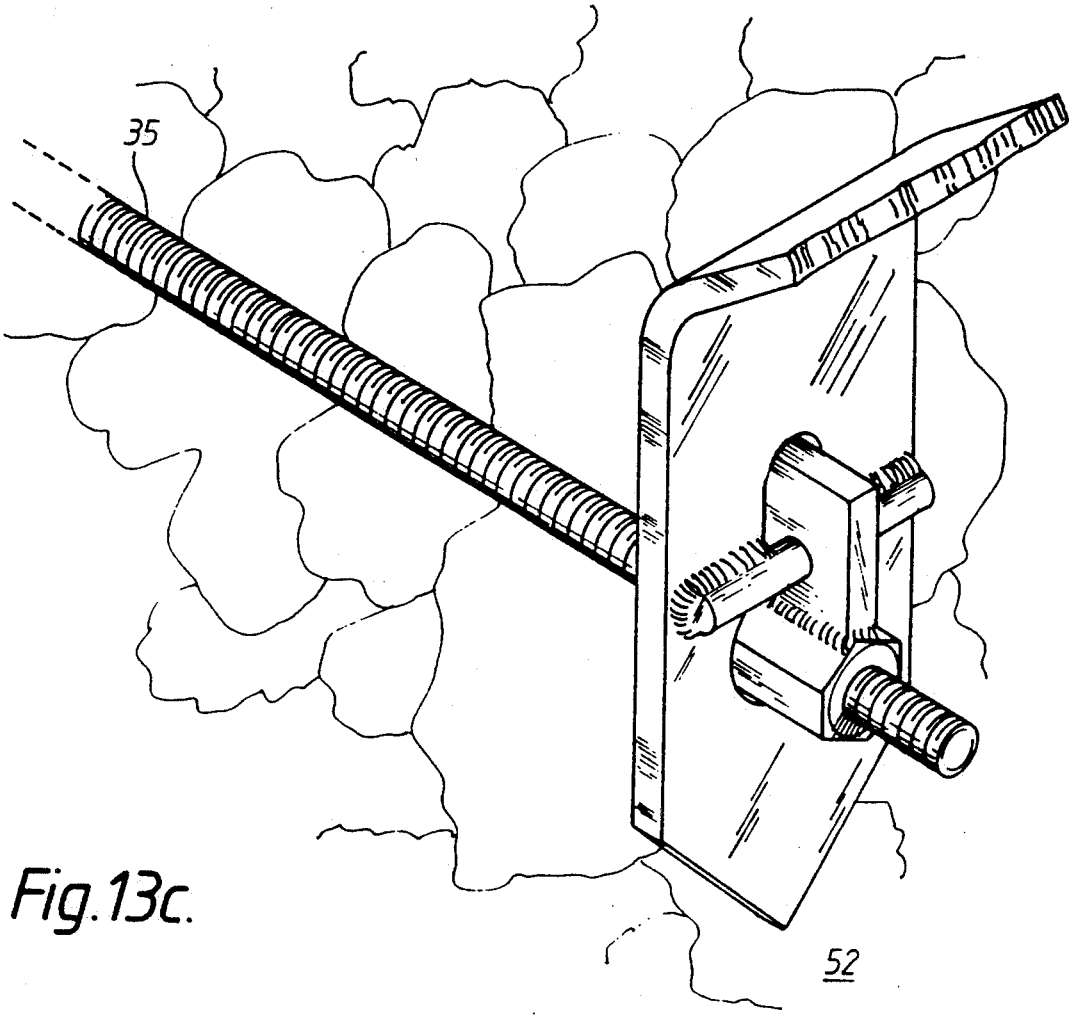

FIGS. 9*a* and 9*b* are sketches of a first anchor constructed in accordance with the present invention;

FIG. 10 is a sketch of a first adapter constructed in accordance with the present invention;

FIG. 11 is a sketch of the anchor illustrated in FIGS. 9*a* and 9*b* with the outer casing and first and second adapters attached;

FIGS. 12*a* to 12*c* is a schematic series sketch of the anchor described in FIGS. 9 and 11 being placed in position;

FIGS. 13*a* to 13*c* are sketches of a second anchor constructed in accordance with the present invention.

Figure 14A:
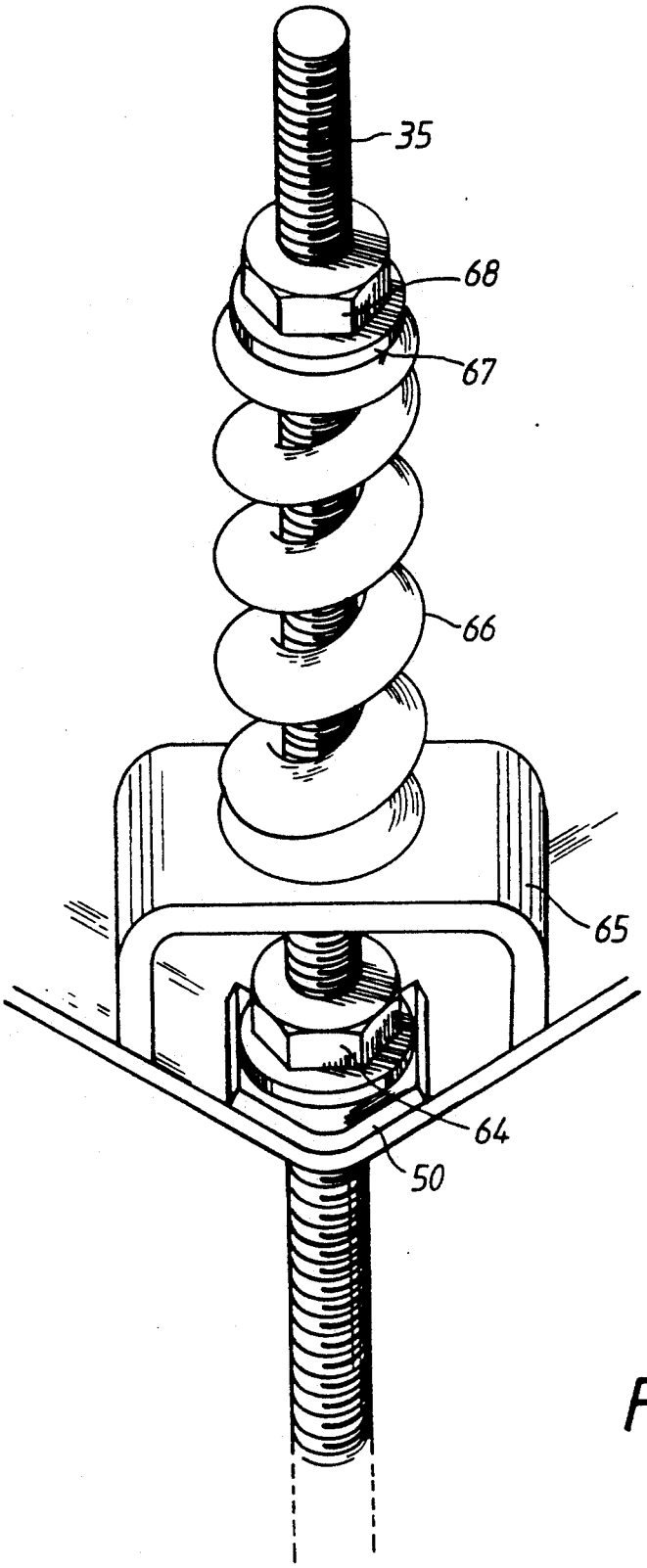

FIGS. 14(*a, b*) are sketches of two embodiments for setting the required tension on the anchors illustrated in the previous FIGS.

Figure 15A:
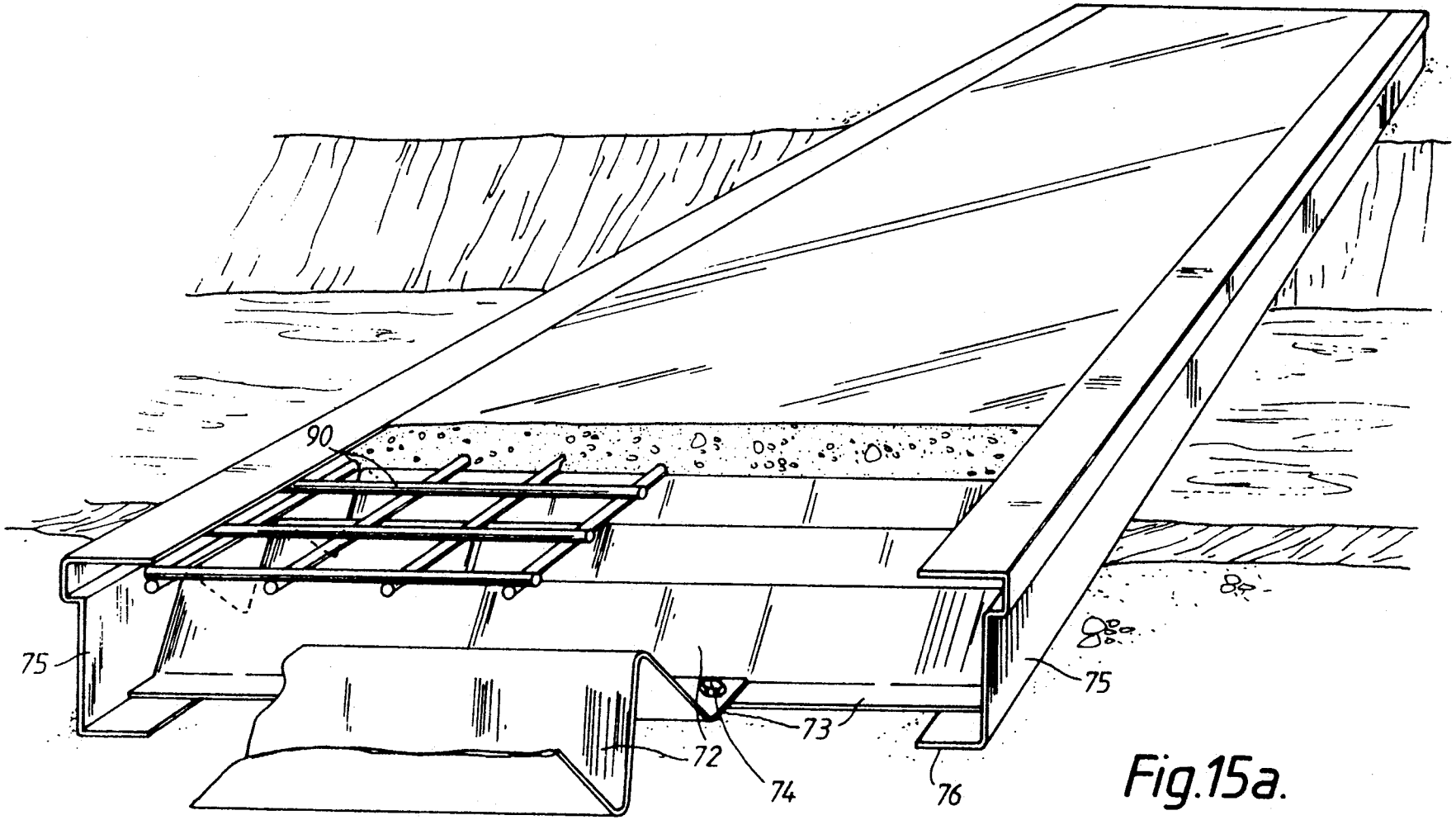

FIG. 15*a* is a sketch of a bridge across a river constructed in accordance with the present invention.

Figure 15B:
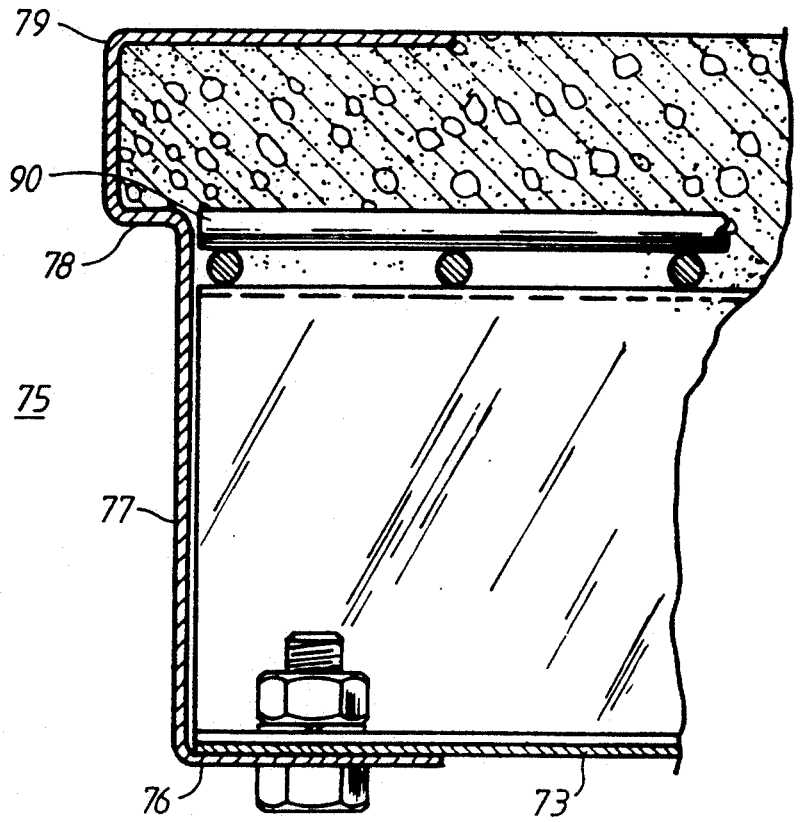

FIG. 15*b* is a partial cross-sectional view of the bridge illustrated in FIG. 15*a*.

Figure 16:
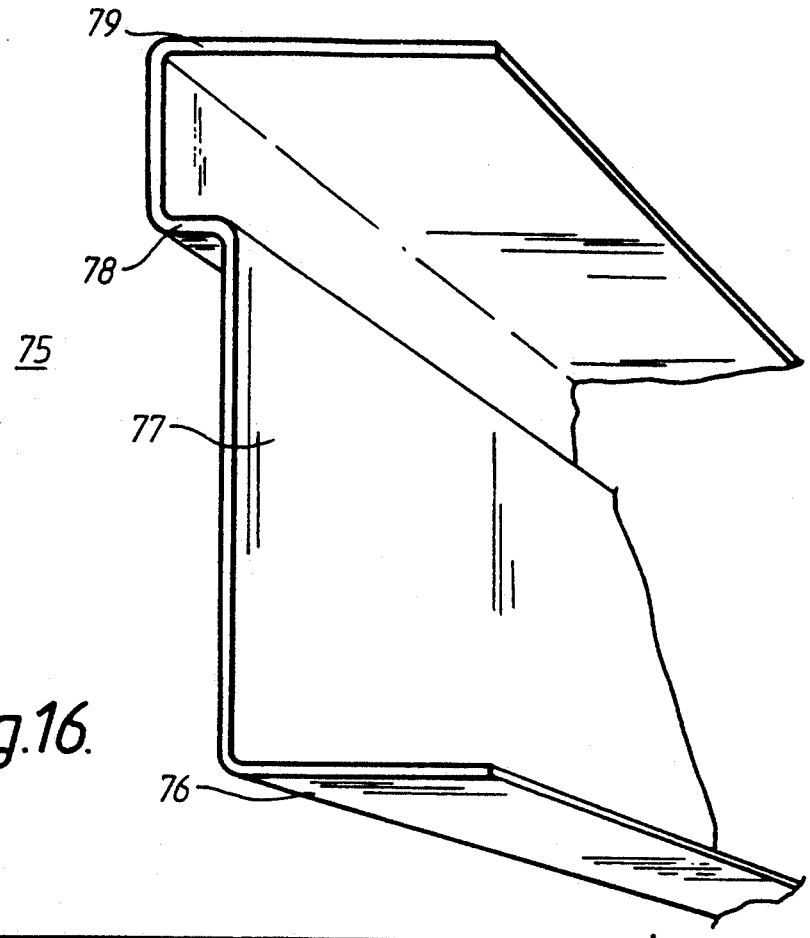

FIG. 16 is a sketch of the edge capping of the bridge illustrated in FIG. 15.

Figure 1:
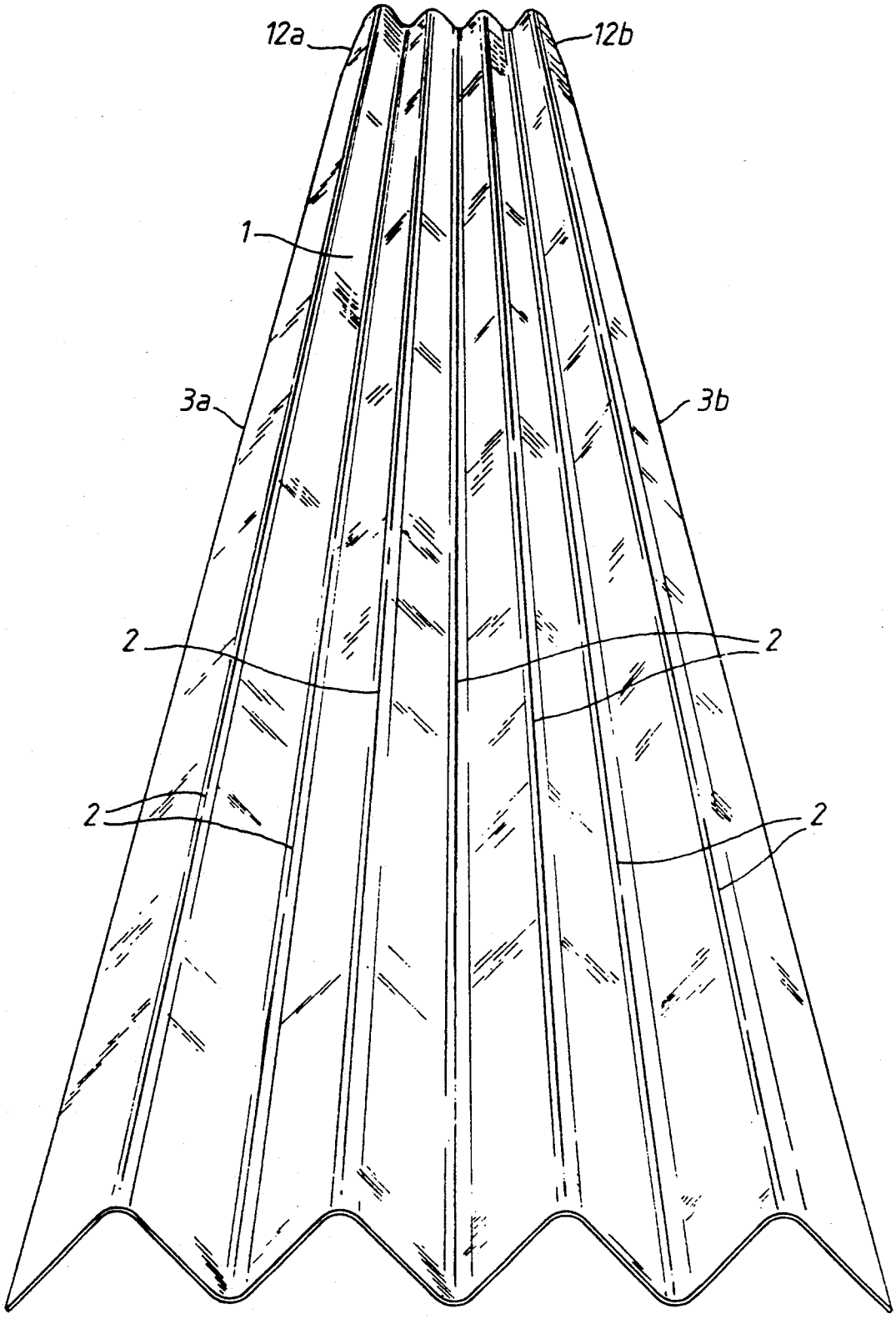
FIG. 1 is a sketch of a cutter sheet constructed in accordance with the present invention.

The cutter illustrated in FIG. 1 comprises an essentially rectangular sheet (1) folded along a number of equi-spaced longitudinal axes (2) to produce the depicted series of pleats. Short sections 12(*a, b*) of the outside edges 3(*a, b*) of the two outer folds are angled inward.

In the support sheet depicted in FIG. 2, the rectangular sheet (1), pleats and the short sections 12(*a, b*) are substantially as in the cutter sheet of FIG. 1. However, the thickness of the support sheet is less than that of the cutter sheet. Further, holes 4(*a, b*) are positioned near the top edge (5).

FIGS. 3*a* and 3*b* and FIGS. 3*c* and 3*d* respectively depict two adapters for use with the support sheet. Each adapter comprises an essentially rectangular sheet (6) folded about its shorter axis in a similar manner as the support sheet of FIG. 2. In the adapter illustrated in FIGS. 3*a* and 3*b*, a plate (14) is affixed across the central fold. (The plate (14), apart from imparting rigidity to the adapter, can also be used as a connection point for attaching the adapter to the source of repetitive impact force.) In each adapter, brackets (7) are affixed at the top edge (8); and holes 9 and 10 are positioned in the brackets (7) and sheet (6) respectively such that they can align with the holes 4(*a, b*) of the support sheet (3) to allow bolts (11) to pass through as illustrated in FIGS. 4*a* to 4*d*.

The two attachments (17) illustrated in FIGS. 5*a* and 5*b* and 5*c* and 5*d*, respectively each comprise an elongated channel (15) of "square C" cross-section. The width of the channel (15) is slightly greater than the depth of the pleats of the support sheet illustrated in FIG. 2. A member (16) of H cross section is affixed approximately mid centre of the channel (15) and extends away from the open section of the elongated channel (15).

In use, the cutter sheet, if required, can be gripped by any suitable means, e.g., by the well known pile-driver, and driven longitudinally into the ground to cut tree roots etc. The cutter sheet is then removed by any conventional means. If necessary, the adapter is attached to the support sheet as illustrated in FIGS. 4*a* to 4*d* before driving the sheet into the ground. Also, if necessary, after the adapter has been removed, the member (16) of the attachment (17) is affixed to, e.g., the pile driver, and the channel member (15) positioned over the top of the support sheet so that the top fits into the mouth of the channel. The support sheet is then driven to ground level. After the support sheet is at the required depth, if required, a second (and any subsequent) support sheet is driven into the ground, overlapping the first support sheet as illustrated in FIG. 6.

In the building element illustrated in FIG. 7, the rectangular sheet (1), pleats, short sections 12(*a, b*) and holes 4(*a, b*) (optional) (not illustrated) are substantially as in the support sheet depicted in FIG. 2. A casing (18) is affixed to the sheet (1) by any suitable means, the casing comprising a double walled nylon mattress (20) held together at intervals by filter points (19). The casing is filled with, for example, fine aggregate concrete (21) by pressure injection until the mattress is inflated to assume a position which essentially follows the contours of the sheet but leaving a gap g between the wall of the mattress and the base b of each fold. The filter points (19) remain free of concrete. The gap g further assists wave energy dissipation as the waves attempt to force the mattress into closer contact with the sheet.

In use, the required number of sheets (1) are driven into the ground at the required angle and to the required depth following the procedure described above. If necessary, excavation of the soil or the like is undertaken from the water side of the revetment. A casing (18) as described with reference to FIG. 7 is then placed over one face of the sheets and then pumped full of fine aggregate concrete.

It should be noted that the positioning of the casing and the subsequent filling with concrete can be undertaken even though the sheet(s) may be under water.

This feature is particularly advantageous for the construction of groins, breakwaters and the like where it is impossible to drain, or to divert the flow of, the water. As illustrated in FIG. 8, spaced walls 22(*a, b*) can extend from the shoreline (24) out to sea for the required distance and an end wall (23) is then positioned. Each spaced and end walls are as described above with reference to FIG. 7. The breakwater is then completed by positioning rocks (25), pumping sand or other suitable fill between the walls. (Although the casing (18) is illustrated as covering only one face of each sheet (1), in practice, it is more likely that the casing (18) will extend over the top edge of each sheet and down the other face thereof, each end of the casing (18) then being buried below ground/sea bed level.)

In FIGS. 9*a* and 9*b*, the anchor comprises a soil engaging means (26) consisting of a plate (27) two sides of which taper to a point (28) at one end. The other end is bifurcated providing segments (80) each of which are curved at an inclination to the plane of the plate (27) and sufficiently separated to provide a significant straight edge (44). Additional shaped, curved wing segments 30(*a, b*), one affixed to each side of the plate, are positioned to follow the inclination set by the plate (27) and its bifurcated end. A key-hole shaped aperture (29) is positioned in the plate (27) near to the point (28). A pivot arm (31) is secured across the aperture (29) and at approximate right angles to the longitudinal axis of the plate (27). Pivotally connected to the arm (31), via a plate (33), is a short internally threaded open ended tube (32). The aperture (29), pivot arm (31) and tube (32) are adapted such that the tube (32) can be positioned initially substantially parallel to the said longitudinal axis but allows the outer side (81) of the tube (32) to abut the inner edge (34) of the aperture (29) when the plate (27) pivots through 90 degrees as illustrated in FIG. 9*b*.

FIG. 10 illustrates an adapter (42) comprising a substantially bullet shaped member (36). An externally threaded tube (37) is affixed to the rear of the member (36). A section of the member (36) is removed to create a flat surface (38). A triangular segment (39) is affixed to the member (36) and extends forward over the flat surface (38) to create a slot (40). A hole (41) passes through the entire length of the adapter.

In use, as illustrated in FIG. 11, a threaded rod (35) is screwed to the open ended tube (32). An elongated tube (43)—which is internally threaded for a short distance from either end—is attached to the threaded tube (37) of the adapter (42) and the rod (35) passed through until the slot (40) engages the edge (44) of the plate (27) thus holding the blade (26) in a closed position. The rod (35) protrudes from the other end of the tube (43) for a short distance. A second adapter (45) comprising a hexagonal nut (46)—either side of which is attached short externally threaded tubes 47(*a, b*)—is placed over the protruding end of the rod (35) and screwed into the end of the tube (43) until the nut (46) abuts the end edge of the tube (43).

As illustrated in FIGS. 12*a*–12*c*, a hole is positioned in the retaining wall (47) of sufficient diameter to allow the anchor to be placed through with the blade (26) in its closed position (FIG. 12*a*). By applying a force to the end of the second adapter (45), the anchor can be driven into the ground at the required angle and to the required depth. Although any suitable means can be used to drive the anchor into the ground, an air driven machine is preferred as a secondary benefit of the air flowing down through the second adapter (45), tube (43) and first adapter (42) is that the threads of the rod (35) are kept clear of soil, grit etc as the anchor passes through the ground. As illustrated in FIG. 12*b*, the second adapter (45) is removed and the tube (43) disengaged from the plate (27) (for example, by application of a force to the rod (35) to move the anchor further into the ground or by partial or total removal of the tube (43) from the ground). A plate (50) —of a shape identical to a single fold of the sheet (1) —with an aperture is placed in position on the outside of the wall (47) and a nut (51) positioned on the rod (35) is tightened. As the nut (51) is tightened the movement of the rod (35) causes the blade (26) to assume its open position (FIG. 12*c*) thus causing resistance to its passage through the soil. The nut (51) is tightened until the required tension is reached.

The anchor illustrated in FIGS. 13*a* and 13*b* comprises a blade (52) consisting of a narrow plate (53) two sides of which taper to a point (54) at one end. The other end of the plate (53) is curved at an inclination to the plane of the plate (53) to form a tail (55). The edge (56) of the tail (55) is roughly serrated. A key-hole shaped aperture (57) is positioned in the plate (53) near to the point (54). A pivot arm (58) is secured across the aperture (57) and at approximate right angles to the longitudinal axis of the plate (53). Pivotally connected to the arm (58) via a plate (59)—is a short internally threaded open ended tube (60). The aperture (57), pivot arm (58) and tube (60) are adapted such that the tube (60) can be positioned initially substantially parallel to the said longitudinal axis but allows the outer side (61) of the tube (60) to abut the inner edge (62) of the aperture (57) when the plate (53) pivots through 90 degrees as illustrated in FIGS. 13*a* and 13*c*. An externally threaded rod (35) is connected to the tube (60).

In use, a hole is first drilled by any conventional means to establish a passageway for the anchor depicted in FIGS. 13*a–c*. A hole is positioned in the retaining wall of sufficient diameter to allow the anchor-attached to the rod (35)—to be passed through and down the afore-said predrilled passageway. (To insert, the tail (55) is inclined upwards, the plate (53) thus resting on the threaded rod (35).) When the anchor is at the required depth, the rod is turned to enable the blade (52) to assume a partial open position under the influence of gravity. The protruding end of the rod (35) is affixed to the retaining wall in a similar manner to that described above with reference to FIGS. 12*a–c*. This initial tensioning beds the anchor into the ground. The tension is removed and the passageway filled with cement grout and the anchor is again re-tensioned. The retaining wall is ready for immediate use even though the cement grout has not set, however, if required, further re-tensioning can occur once the grout has set.

A number of devices can be used to monitor the required tension for either anchor. For example (FIG. 14*a*), prior to any tensioning, a floating nut (64) can be placed on the rod (35) and abutted to the plate (50). A bridge (65) can then be positioned over the rod (35) followed by a pre-graded compression spring (66) and, if necessary, a washer (67). The spring (66) is compressed by turning a second nut (68) positioned on the rod (35) until the required tension is reached. The floating nut (64) is periodically tightened against the wall (1).

Alternatively, a conventional pressure measuring gauge (not illustrated) can be used in place of the spring (66).

Figure 14B:
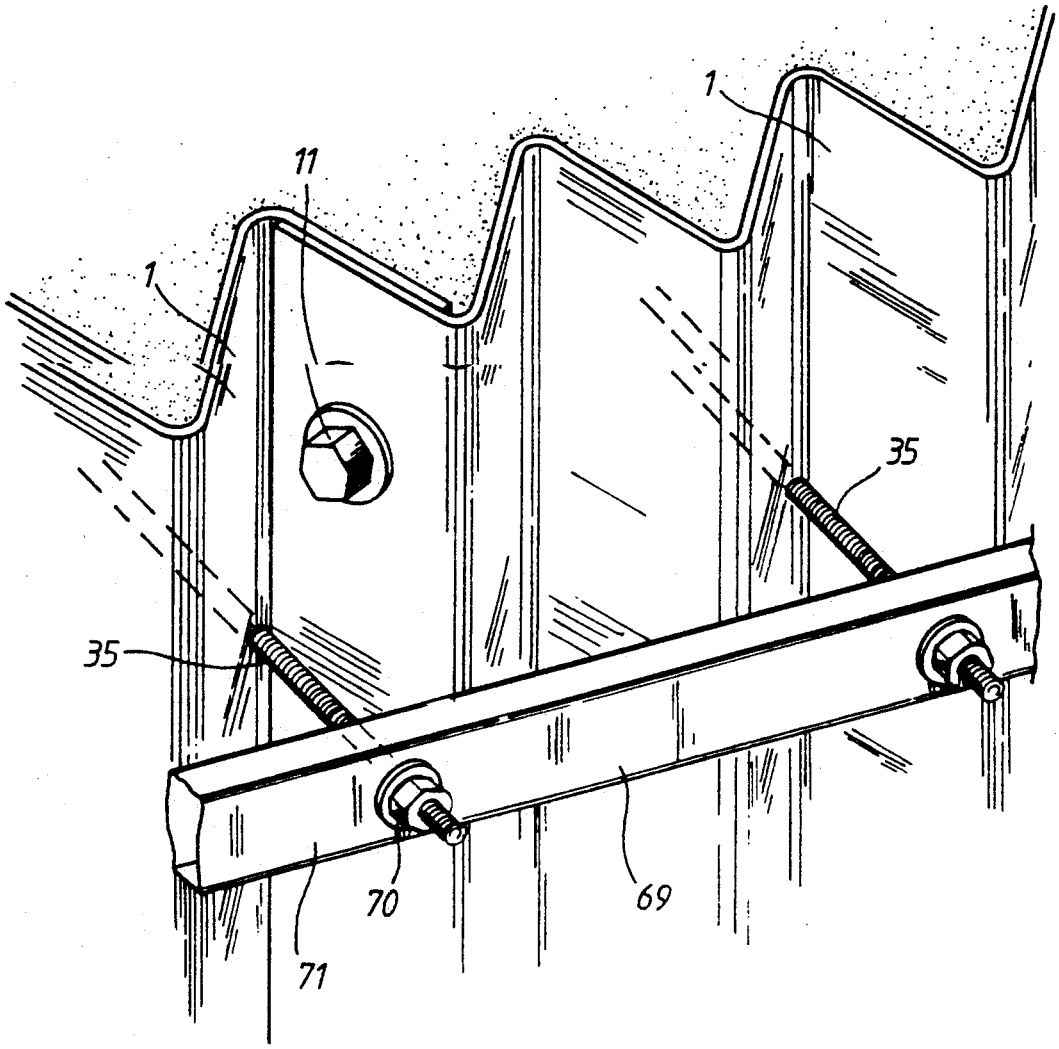

Yet another alternative is to provide a waler (69) which comprises a hollow tube of rectangular cross section. This waler is pretested so that it is known to deform at a certain pressure. Therefore, the waler can be positioned as illustrated in FIG. 14*b* and the nut (70) tightened until the surface (71) deforms. A waler is a particularly advantageous embodiment as a single waler can be used to tension a number of anchors as also illustrated in FIG. 14*b*.

The road way illustrated in FIGS. 15*a* (depicted bridging a waterway) and 15*b* comprises a number of rectangular sheets (72) each folded about its longitudinal axis to produce a series of pleats. A narrow flange (73) extends from both longitudinal edges. Adjacent sheets (72) are positioned such that the respective flanges (73) overlap and are joined together by a conventional nut and bolt arrangement (74). Optionally, the underside of each sheet (72) may be coated with any suitable corrosion-resistant material. Conventional metal mesh (90) is laid over the sheets (72) and, for example, spot welded thereto. An edge capping (75) of the profile illustrated in FIG. 16 is fixed along the open ends of the pleats. The lower lip (76) of the capping (75) sits under the sheets (72) and is attached thereto by bolts passing through the lip (76) and flanges (73). The edge (77) abuts the ends of the sheets and the lip (78) is approximately at the same height as the top of the pleats. The upper lip (79) is at a height corresponding to the required depth of the infill material. The upper surface of this lip (79) provides a convenient screed level for the infill material.

By using the present invention, a significant number of advantages are apparent. These advantages include:

The cost of the thinner gauge support sheets is sufficiently reduced such that it can be economical for them to remain in the ground after their purpose has been fulfilled. This is particularly advantageous when working in narrow confines where it can be almost impossible to retrieve the support sheets without damage to either the newly formed footings, walls etc or to an existing adjacent building.

A further advantage of this disposability of the support sheets is that, by remaining in situ, they can also be used as formwork for the foundations and the like of the new construction. This provides economic advantages in that, after constructing the retaining wall, it may not be necessary to utilise additional resources and personnel in erecting the required formwork for, for example, the subsequent pouring of the concrete for the foundations.

The lower impact forces required to drive the support sheets into the ground give rise to much lower shock waves through the ground which reduces the chance of damage to existing adjacent buildings.

The overall lesser bulk of the implements of the invention and the equipment necessary to drive the sheets into the ground enables retaining walls and the like to be erected closer to existing buildings than is possible using other known methods.

In this regard, as the sheets can be positioned at reverse angles, they can be placed close to existing buildings without any eaves etc to be removed first as is the case with the prior art piles.

To a certain extent, the required "strength" of a retaining wall can be varied by altering the degree of "overlap" of adjacent sheets. For example, an overlap of two "folds" provides, in effect, a strengthened pole every few meters—such an arrangement is extremely strong and stable. This strength is superior to the prior art interlocking piles but the sheets can readily be removed again if desired.

As rust, dirt etc collects in the grooves of the prior art piles, they virtually lock solid, it requiring a tremendous force to remove them. This is not a problem with the support sheets of the present invention should it be necessary to remove the sheets from the ground.

A retaining wall can be constructed in a body of water such as a dam or a lake which is sufficiently water tight to enable partial draining of the dam or the like from one side of the wall. After the required work has been undertaken on the drained side, a support sheet can be slowly removed allowing a controlled flow of water to pass under thereof.

It is possible to construct a support wall for a revetment before *any* excavation is undertaken; the angle of the support wall can be chosen to reduce wave run up at wave deflection off the revetment; and as the support wall is essentially water tight, should any excavation of the water side be required, this can be undertaken from the dry side of the wall.

By using the thinner gauge sheets and an overlaid casing, the costs of manufacturing a breakwater and the like can be significantly reduced but the overall strength is improved.

The present invention is particularly suited to revetments—both above and below water—for use in beach shoreline protection, bridge abutments, road and rail embankments, dams, rivers, spillways, irrigation and stormwater canals, slipways, retaining walls, breakwaters and the like.

Should it be necessary to strengthen any retaining wall or the like, an anchor can be relatively quickly positioned for *immediate* use. The compact nature of the anchor when in the closed position and the fact that it can be positioned by means remote from the blade end provides a major advantage in that the anchor can be easily positioned close to, for example, the existing foundations of any adjacent building. Further advantages include the cost which is substantially less than existing devices and that a number of items from the anchor are reusable. An important advantage is that no destressing of the anchor is required after it has been positioned and served its intended purpose. A further advantage is that the anchor can be re-tensioned at any time throughout its structural life, unlike prior art anchors. Alternatively, if it is no longer necessary to maintain constant tension on the retaining wall, the anchor and its method of insertion can be designed such that all components of the anchor, with the exception of the blade, can readily be removed from the ground.

The basic support sheet can also be used as a road way surface which is load bearing for vehicles and the like even before any final surface material is laid. Thus, for example, the sheets can be laid directly on the existing ground surface and essentially be ready for immediate use.

Another major advantage is that the various sheets and anchors of the present invention can be prepared on site. The steel can be delivered on site and as the machines for folding and cutting the steel are portable, the required number and shape of items can be manufactured on site. This represents a significant reduction in transportation and manufacturing costs. It is estimated that the present invention is much stronger than known existing systems but can be put into effect for approximately 25% of the cost.

It will be appreciated that the above described embodiments are examples only and that modifications can be made to the present invention described herein without departing from the inventive concept as defined in the following claims.

We claim:

1. A method of constructing a load bearing surface including at least one inter-connectable corrugated sheet, each inter-connectable sheet having at least one alternating radiused ridge and radiused trough connected by a linear web, said method comprising the steps of:

(a) providing at least one adapter also comprising a corrugated sheet having corrugations complementary to those of said inter-connectable sheet, said at least one adapter having means for temporary attachment to said inter-connectable sheet;

(b) using said at least one adapter to place said inter-connectable sheet into its required position; and (c) removing each of said at least one adapter so that no adapters remain attached to said sheet.

2. A method as defined in claim 1 wherein, prior to placing said inter-connectable sheet into said required position, another sheet is first driven into ground at a required angle and to a required depth to penetrate obstructive material that may be present in the ground, said another sheet then being removed, said another sheet comprising a corrugated sheet having corrugations complementary to those of said inter-connectable sheet.

3. A method as defined in claims 1, further comprising the steps of:

(a) further adapting said inter-connectable sheet to comprise a narrow flange along a full length of each of its two longitudinal edges; and (b) positioning a resultant sheet such that corrugations are transverse to a flow of traffic that will use said roadway, any successive resultant sheet being positioned such that adjacent said narrow flanges overlap.

4. A method as defined in claim 3, wherein infill material is positioned on a surface of said sheet which will be in direct contact with said flow of traffic.

5. A method as defined in claim 4 wherein said infill material is retained on said surface between continuous-type edge cappings extending parallel to said flow and connected to said flanges.

6. A method as defined in claim 1, wherein said using step comprises applying a driving force directly to each of said at least one adapter.

7. A method of constructing a load bearing surface including at least one inter-connectable corrugated sheet, said inter-connectable sheet having at least one alternating radiused ridge and radiused trough connected by a linear web, said method comprising the steps of:

(a) providing at least one adapter also comprising a corrugated sheet having corrugations complementary to those of said inter-connectable sheet, said at least one adapter each having means for temporary attachment to said inter-connectable sheet;

(b) using said at least one adapter to place said inter-connectable sheet to an approximation of its required position;

(c) removing each of said at least one adapter so that no adapters remain attached to said sheet;

(d) placing an attachment in temporary communication with a top of said inter-connectable sheet and further positioning said inter-connectable sheet to its required position in ground; and (e) removing said attachment;

wherein said attachment comprises:

(a) an elongated member defining a channel of a width slightly greater than the depth of one of said ridges and said troughs;

(b) means to releasably connect said elongated member to a source of a vibrating force;

wherein each side of said channel is further adapted to comprise a short extension, each said extension comprising a corrugated sheet having corrugations complementary to those of said inter-connectable sheet.

8. A method as defined in claim 7 wherein, prior to placing said inter-connectable sheet into said required position, another sheet is first driven into ground at a required angle and to a required depth to penetrate obstructive material that may be present in the ground, said another sheet then being removed, said another sheet comprising a corrugated sheet having corrugations complementary to those of said inter-connectable sheet.

9. A method as defined in claim 7, wherein said using step comprises applying a driving force directly to each of said at least one adapter.

10. A method of constructing a revetment having at least one inter-connectable corrugated sheet, said sheet having at least one alternating radiused ridge and radiused trough connected by a linear web, said method comprising the steps of:

(a) providing at least one adapter also comprising a corrugated sheet having corrugations complementary to those of said inter-connectable sheet, said at least one adapter having means for temporary attachment to said inter-connectable sheet;

(b) using said at least one adapter to place said inter-connectable sheet into its required position;
(c) removing each of said at least one adapter so that no adapters remain attached to said sheet;
(d) excavating any material that may be present from one face of said inter-connectable sheet; and
(e) overlying a casing on said one face, said casing being filled with a robust material.

11. A method as defined in claim 10 wherein, prior to placing said inter-connectable sheet into said required position, another sheet is first driven into ground at a required angle and to a required depth to penetrate obstructive material that may be present therein, said another sheet then being removed, said another sheet comprising a corrugated sheet having corrugations complementary to those of said inter-connectable sheet.

12. A method as defined in claim 10, wherein said using step comprises applying a driving force directly to each of said at least one adapter.

13. A method of constructing a revetment having at least one inter-connectable corrugated sheet, said inter-connectable sheet having at least one alternating radiused ridge and radiused trough connected by a linear web, said method comprising the steps of:
(a) providing at least one adapter also comprising a corrugated sheet having corrugations complementary to those of said inter-connectable sheet, said at least one adapter having means for temporary attachment to said inter-connectable sheet;
(b) using said at least one adapter to place said inter-connectable sheet to an approximation of its required position;
(c) removing each of said at least one adapter so that no adapters remain attached to said sheet;
(d) placing an attachment in temporary communication with a top of said inter-connectable sheet and further positioning said inter-connectable sheet to its required position in ground;
(e) removing said attachment;
(f) excavating any material that may be present from one face of said inter-connectable sheet; and
(g) overlying a casing on said one face, said casing being filled with a robust material;

wherein said attachment comprises;
(a) an elongated member defining a channel of a width slightly greater than a depth of one of said ridges and said troughs;
(b) means for releasably connecting said elongated member to a source of a vibrating force;

wherein each side of said channel further comprises a short extension, each said extension comprising a corrugated sheet having corrugations complementary to those of said inter-connectable sheet.

14. A method as defined in claim 13 wherein, prior to placing said inter-connectable sheet into said required position, another sheet is first driven into ground at a required angle and to a required depth to penetrate obstructive material that may be present therein, said another sheet then being removed, said another sheet comprising a corrugated sheet having corrugations complementary to those of said inter-connectable sheet.

15. A method as defined in claim 13, wherein said using step comprises applying a driving force directly to each of said at least one adapter.

16. A method of constructing a load bearing surface including at least one inter-connectable corrugated sheet, each inter-connectable sheet having at least one alternating radiused ridge and radiused trough connected by a linear web, said method comprising the steps of:
(a) providing an adapter also comprising a corrugated sheet having corrugations complementary to those of said inter-connectable sheet, said adapter having means for temporary attachment to said inter-connectable sheet;
(b) using said adapter to place said inter-connectable sheet into its required position;
(c) removing said adapter;
(d) passing through at least one of said inter-connectable sheets at least one anchor comprising an elongated rod having a blade-like soil engaging means pivotally connected at one end and capable of movement from a first closed position to a second open position, and a second end of said rod being adapted to be secured to said inter-connectable sheet in said first closed position, into ground at a required angle and to a necessary depth;
(e) causing said blade-like means to assume said second open position; and
(f) securing said second end of said rod to said inter-connectable sheet in such a manner to substantially prevent any movement of said inter-connectable sheet under the influence of pressure;

said soil engaging means including
a plate, two sides of which taper to a point,
an end of said plate opposite to said point being bifurcated to provide segments, each segment being curved at an inclination to a plane of said plate,
curved wing segments, one affixed to each side of said plate, each wing segment following an inclination set by said plate and its said bifurcated end,
an aperture in said plate, and
means pivotally connected across said aperture to allow said plate to rotate through no more than approximately 90 degrees.

17. A method as defined in claim 16, wherein said anchor is first attached to a rod, an outer casing is then positioned over said rod, one end of said casing being releasably affixed to a first adaptor which holds said anchor in said closed position, a second end of said outer casing being affixed to a second adaptor which, in turn, is releasably affixed to a source of a repetitive impact force, no later than when said anchor is paired through said inter-connectable sheet.

18. A method as defined in claim 17 wherein, prior to said passing said anchor through said interconnectable sheet, a channel is first created in said soil to accommodate said anchor attached to said rod and said outer casing.

19. A method as defined in claim 18, wherein said first adaptor comprises:
(a) a cylindrical body member;
(b) a frusto-conical member extending from one end of, and coaxially with, said body member, said frusto-conical member having a section removed to create essentially a flat surface on one side thereof;
(c) a holding member affixed to said body member and extending from said one end such that a slot is formed between said holding member and said flat surface of said frusto-conical member;
(d) an externally threaded tube extending from a second end of, and coaxial with, said body member; and (e) a bore passing through an entire longitudinal length of said first adapter;

so that said rod of said anchor can pass through said bore and said plate of said anchor can be retained in said slot to retain said anchor in said first closed position.

20. A method as defined in claim 17, wherein said first adaptor comprises:

(a) a cylindrical body member;

(b) a frusto-conical member extending from one end of, and coaxial with, said body member, said frusto-conical member having a section removed to create essentially a flat surface on one side thereof;

(c) a holding member affixed to said body member and extending from said one end such that a slot is formed between said holding member and said flat surface of said frusto-conical member;

(d) an externally threaded tube extending from a second end of, and coaxially with, said body member; and (e) a bore passing through an entire longitudinal length of said first adaptor;

so that said rod of said anchor can pass through said bore and said plate of said anchor is retained in said slot to retain said anchor in said first closed position.

21. A method of constructing a load bearing surface including at least one inter-connectable corrugated sheet, each inter-connectable sheet having at least one alternating radiused ridge and radiused trough connected by a linear web, said method comprising the steps of:

(a) providing an adapter also comprising a corrugated sheet having corrugations complementary to those of said inter-connectable sheet, said adapter having means for temporary attachment to said inter-connectable sheet;

(b) using said adapter to place said inter-connectable sheet into its required position;

(c) removing said adapter;

(d) passing through at least one of said inter-connectable sheets at least one anchor comprising an elongated rod having a blade-like soil engaging means pivotally connected at one end and capable of movement from a first closed position to a second open position, and a second end of said rod being adapted to be secured to said inter-connectable sheet, into ground at a required angle and to a necessary depth;

(e) causing said blade-like means to assume said second open position; and (f) securing said second end of said rod to said inter-connectable sheet in such a manner to substantially prevent any movement of said inter-connectable sheet under influence of pressure;

said soil engaging means including a plate, two sides of which taper to a point, a second end of said plate being curved at an inclination to a plane of said plate an aperture in said plate, and means pivotally connected across said aperture to allow said plate to rotate through no more than approximately 90 degrees.

* * * * *